US009816754B2

(12) United States Patent
Chen et al.

(10) Patent No.: US 9,816,754 B2
(45) Date of Patent: Nov. 14, 2017

(54) INTEGRATED NITROGEN REMOVAL IN THE PRODUCTION OF LIQUEFIED NATURAL GAS USING DEDICATED REINJECTION CIRCUIT

(71) Applicant: AIR PRODUCTS AND CHEMICALS, INC., Allentown, PA (US)

(72) Inventors: Fei Chen, Whitehouse Station, NJ (US); Yang Liu, Allentown, PA (US); Gowri Krishnamurthy, Allentown, PA (US); Christopher Michael Ott, Laurys Station, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 10 days.

(21) Appl. No.: 14/260,643

(22) Filed: Apr. 24, 2014

(65) Prior Publication Data

US 2015/0308736 A1 Oct. 29, 2015

(51) Int. Cl.
*F25J 3/00* (2006.01)
*F25J 3/02* (2006.01)
(Continued)

(52) U.S. Cl.
CPC ..... *F25J 3/0257* (2013.01); *F25J 1/004* (2013.01); *F25J 1/0022* (2013.01); *F25J 1/0025* (2013.01);
(Continued)

(58) Field of Classification Search
CPC ..... F25J 3/0233; F25J 3/0257; F25J 2215/40; F25J 2215/42; F25J 2215/60;
(Continued)

(56) References Cited

U.S. PATENT DOCUMENTS 3,596,473 A 8/1971 Streich
3,721,099 A 3/1973 Forg et al.
(Continued)

FOREIGN PATENT DOCUMENTS

DE 102009015766 A1 10/2010
DE 102011109234 A1 2/2013
(Continued)

OTHER PUBLICATIONS

Anonymous, "Nitrogen Rejection Unit (NRU) Configurations", Published Sep. 21, 2012, IP.com Prior art database Technical disclosure, IP.com No. 000222164.*
(Continued)

*Primary Examiner* — Keith Raymond
(74) *Attorney, Agent, or Firm* — Eric J. Schaal

(57) ABSTRACT

A method and apparatus for liquefying a natural gas feed stream and removing nitrogen therefrom to produce a nitrogen-depleted LNG product, in which a natural gas feed stream is passed through main heat exchanger to produce a first LNG stream, which is separated to form a nitrogen-depleted LNG product and a recycle stream composed of nitrogen-enriched natural gas vapor, and in which the recycle stream is passed through main heat exchanger to produce a first LNG stream, separately from and in parallel with the natural gas feed stream, to produce a first at least partially liquefied nitrogen-enriched natural gas stream that is separated to provide a nitrogen-rich vapor product.

5 Claims, 11 Drawing Sheets

(51) Int. Cl.
*F25J 1/00* (2006.01)
*F25J 1/02* (2006.01)

(52) U.S. Cl.
CPC ..... *F25J 1/0042* (2013.01); *F25J 1/0055* (2013.01); *F25J 1/0212* (2013.01); *F25J 1/0238* (2013.01); *F25J 3/0209* (2013.01); *F25J 3/0233* (2013.01); *F25J 2200/02* (2013.01); *F25J 2200/40* (2013.01); *F25J 2200/70* (2013.01); *F25J 2200/76* (2013.01); *F25J 2205/02* (2013.01); *F25J 2205/04* (2013.01); *F25J 2210/90* (2013.01); *F25J 2215/04* (2013.01); *F25J 2230/08* (2013.01); *F25J 2240/30* (2013.01); *F25J 2245/90* (2013.01); *F25J 2270/18* (2013.01); *F25J 2270/66* (2013.01); *F25J 2290/62* (2013.01)

(58) Field of Classification Search
CPC .. F25J 2220/44; F25J 2220/62; F25J 2245/90; F25J 1/0022; F25J 1/0025; F25J 2200/38; F25J 2210/60; F25J 3/0238; F25J 2215/44; F25J 2215/04; F25J 2220/40; F25J 2245/42
USPC ..... 62/927, 611
See application file for complete search history.

(56) References Cited

U.S. PATENT DOCUMENTS

| | | | | |
|---|---|---|---|---|
| 4,225,329 | A * | 9/1980 | Bailey | F25J 1/0022 62/623 |
| 4,411,677 | A | 10/1983 | Pervier et al. | |
| 4,504,295 | A | 3/1985 | Davis et al. | |
| 4,878,932 | A * | 11/1989 | Phade | F25J 3/0209 62/620 |
| 6,192,705 | B1 * | 2/2001 | Kimble, III | F25J 1/0204 62/48.2 |
| 6,199,403 | B1 * | 3/2001 | Cole | F25J 1/0022 62/613 |
| 6,837,071 | B2 * | 1/2005 | Oakey | F25J 3/0209 62/631 |
| 7,520,143 | B2 | 4/2009 | Spilsbury | |
| 8,522,574 | B2 | 9/2013 | Crawford et al. | |
| 2002/0194866 | A1 | 12/2002 | Oakey | |
| 2003/0177786 | A1 | 9/2003 | O'Brien | |
| 2004/0231359 | A1 | 11/2004 | Brostow et al. | |
| 2010/0077796 | A1 | 4/2010 | Gadre et al. | |
| 2011/0041389 | A1 | 2/2011 | Bauer et al. | |
| 2011/0226009 | A1 | 9/2011 | Paradowski et al. | |
| 2011/0289963 | A1 | 12/2011 | Price | |
| 2012/0019883 | A1 | 1/2012 | Chae et al. | |
| 2012/0285196 | A1 | 11/2012 | Fiinn et al. | |
| 2015/0135767 | A1 | 5/2015 | Currence et al. | |

FOREIGN PATENT DOCUMENTS

| | | | |
|---|---|---|---|
| GB | 2297825 | A | 8/1996 |
| JP | 2002528693 | | 9/2002 |
| JP | 2009504838 | | 2/2009 |
| JP | 2013036676 | | 2/2013 |
| WO | 2009137168 | | 11/2009 |
| WO | 2010040935 | A2 | 4/2010 |
| WO | 2013087569 | | 6/2013 |
| WO | 2013087570 | A2 | 6/2013 |

OTHER PUBLICATIONS ip.com000222164d, Nitrogen Rejection Unit (NRU) Configurations.
Vovard, Sylvain, Nitrogen Removal on LNG Plant—Select the Optimum Scheme, Gas Processors Association—Europe.
Spring Conference 2011, May 25 to 27, Impurities in Gas Processing—How to remove what you don't want, Copenhagen, Gas Processors Association—Europe.

* cited by examiner

INTEGRATED NITROGEN REMOVAL IN THE PRODUCTION OF LIQUEFIED NATURAL GAS USING DEDICATED REINJECTION CIRCUIT

BACKGROUND

The present invention relates to a method for liquefying a natural gas feed stream and removing nitrogen therefrom to produce a nitrogen-depleted, liquefied natural gas (LNG) product. The present invention also relates to an apparatus (such as for example a natural gas liquefaction plant or other form of processing facility) for liquefying a natural gas feed stream and removing nitrogen therefrom to produce a nitrogen-depleted LNG product.

In processes for liquefying natural gas it is often desirable or necessary, for example due to purity and/or recovery requirements, to remove nitrogen from the feed stream while minimizing product (methane) loss. The removed nitrogen product may be used as fuel gas or vented to atmosphere. If used as fuel gas, the nitrogen product must contain a fair amount of methane (typically >30 mol %) to maintain its heating value. In this case, the separation of nitrogen is not as difficult due to loose specifications on the purity of the nitrogen product, and the objective there is to select the most efficient process with minimal additional equipment and power consumption. In many small and mid-scale LNG facilities that are driven by electric motors, however, there is very little demand for fuel gas and the nitrogen product has to be vented to the atmosphere. If vented, the nitrogen product has to meet strict purity specifications (e.g., >95 mol %, or >99 mol %), due to environmental concerns and/or due to methane recovery requirements. This purity requirement poses separation challenges. In the case of a very high nitrogen concentration (typically greater than 10 mol %, in some cases up to or even higher than 20 mol %) in the natural gas feed, a dedicated nitrogen rejection unit (NRU) proves to be a robust method to remove nitrogen efficiently and produce a pure >99 mol %) nitrogen product. In most cases, however, natural gas contains about 1 to 10 mol % nitrogen. When the nitrogen concentration in the feed is within this range, the applicability of the NRU is hindered by the high capital cost due to complexity associated with the additional equipment. A number of prior art documents have proposed alternative solutions to remove nitrogen from natural gas, including adding a nitrogen recycle stream to the NRU or using a dedicated rectifier column. However, these processes often are very complicated, necessitate a large amount of equipment (with associated capital costs), are difficult to operate and/or are inefficient, especially for feed streams of lower nitrogen concentrations (<5%). Furthermore, it is often the case that the nitrogen concentration in a natural gas feed will change from time to time, which means that even if one is dealing with a feed that is currently high in nitrogen content, one cannot guarantee that this will remain the case. It would therefore be desirable to develop a process that is simple, efficient, and capable of removing nitrogen effectively from natural gas feeds with low nitrogen concentrations.

U.S. Pat. No. 3,721,099 discloses a process for liquefying natural gas and separating nitrogen from the liquefied natural gas by rectification. In this process, the natural gas feed is precooled and partially liquefied in a series of heat exchanger units and separated in a phase separator into liquid and vapor phases. The natural gas vapor stream is then liquefied and subcooled in a pipe-coil in the bottom of the double rectification column, providing boilup duty to the high pressure column. The liquid natural gas streams from the pipe-coil is then further subcooled in a heat exchanger unit, expanded in an expansion valve and introduced into and separated in the high pressure column. The methane-rich liquid stream drawn from the bottom of the high-pressure rectification column and the methane-rich liquid stream obtained from the phase separator are subcooled in further heat exchanger units, expanded through expansion valves, and introduced into and separated into the low pressure column. Reflux to the low pressure column is provided by a liquid nitrogen stream obtained from liquefying in a heat exchanger unit a nitrogen stream obtained from the top part of the high pressure column. Nitrogen-depleted LNG (predominately liquid methane) product, containing about 0.5% nitrogen, is obtained from the bottom of the low-pressure column and sent to an LNG storage tank. Nitrogen-rich streams are obtained from the top of the low pressure column (containing about 95 mole % nitrogen) and from the top of the high pressure column. The nitrogen-rich streams and boil-off gas from the LNG tank are warmed in the various heat exchanger units to provide refrigeration therefor.

U.S. Pat. No. 7,520,143 discloses a process in which a nitrogen vent stream containing 98 mole % nitrogen is separated by a nitrogen-rejection column. A natural gas feed stream is liquefied in a first (warm) section of a main heat exchanger to produce an LNG stream that is withdrawn from an intermediate location of the heat exchanger, expanded in an expansion valve, and sent to the bottom of the nitrogen-rejection column. The bottom liquid from the nitrogen-rejection column is subcooled in a second (cold) section of the main heat exchanger and expanded through a valve into a flash drum to provide a nitrogen-depleted LNG product (less than 1.5 mole % nitrogen), and a nitrogen-enriched stream which is of lower purity (30 mole % nitrogen) than the nitrogen vent stream and that is used for fuel gas. The overhead vapor from the nitrogen-rejection column is divided, with part of the vapor being withdrawn as the nitrogen vent stream and the remainder being condensed in a heat exchanger in the flash drum to provide reflux to the nitrogen-rejection column. Refrigeration for the main heat exchanger is provided by a closed loop refrigeration system employing a mixed refrigerant.

US 2011/0041389 discloses a process, somewhat similar to that described in U.S. Pat. No. 7,520,143, in which a high purity nitrogen vent stream (typically 90-100% by volume nitrogen) is separated from the natural gas feed stream in a rectification column. The natural gas feed stream is cooled in a warm section of a main heat exchanger to produce a cooled natural gas stream. A portion of this stream is withdrawn from a first intermediate location of the main heat exchanger, expanded and sent to the bottom of the rectification column as stripping gas. The remainder of the stream is further cooled and liquefied in an intermediate section of the main heat exchanger to from an LNG stream that is withdrawn from a second (colder) intermediate location of the heat exchanger, expanded and sent to an intermediate location of the rectification column. The bottom liquid from the rectification column is withdrawn as a nitrogen-depleted LNG stream, subcooled in a cold section of the main heat exchanger and expanded into a phase separator to provide a nitrogen-depleted LNG product, and a nitrogen-enriched stream which is compressed and recycled back into the natural gas feed stream. The overhead vapor from the rectification column is divided, with part of the vapor being withdrawn as the high purity nitrogen vent stream and the remainder being condensed in a heat exchanger in the phase separator to provide reflux to the rectification column.

IPCOM000222164D, a document on the ip.com database, discloses a process in which a stand-alone nitrogen rejection unit (NRU) is used to produce a nitrogen-depleted natural gas stream and a pure nitrogen vent stream. The natural gas feed stream is cooled and partially liquefied in a warm heat exchanger unit and separated in a phase separator into natural gas vapor and liquid streams. The vapor stream is liquefied in cold heat exchanger unit and sent to the top or to an intermediate location of a distillation column. The liquid stream is further cooled in the cold heat exchanger unit, separately from and in parallel with the vapor stream, and is then sent to an intermediate location of the distillation column (below the location at which the vapor stream is introduced). Boil-up for the distillation column is provided by warming and vaporizing a portion of the nitrogen-depleted bottoms liquid from the distillation column in the cold heat exchanger unit, thereby providing also refrigeration for unit. The remainder of the nitrogen-depleted bottoms liquid is pumped to and warmed and vaporized in the warm heat exchanger unit, thereby providing refrigeration for that unit, and leaves the warm exchanger as a fully vaporized vapor stream. The nitrogen enriched overhead vapor withdrawn from the distillation column is warmed in the cold and warm heat exchanger units to provide further refrigeration to said units. Where the vapor stream is introduced into an intermediate location of the distillation column, additional reflux for the column may be provided by condensing a portion of the overhead vapor and returning this to column. This may be done by warming the overhead vapor in an economizer heat exchanger, dividing the warmed overhead vapor, and condensing a portion of the warmed overhead vapor in the economizer heat exchanger and returning the condensed portion to the top of the distillation column. No external refrigeration is used in this process.

US2011/0289963 discloses a process in which nitrogen stripping column is used to separate nitrogen from a natural gas stream. In this process, a natural gas feed stream is cooled and partially liquefied in a warm section of a main heat exchanger via heat exchange with a single mixed refrigerant. The partially condensed natural gas is withdrawn from the main heat exchanger and separated in a phase separator or distillation vessel into natural gas vapor and liquid streams. The liquid stream is further cooled in a cold section of the main heat exchanger before being expanded and introduced into a nitrogen stripping column. A nitrogen-depleted LNG product (containing 1 to 3 volume % nitrogen) is withdrawn from the bottom of the stripping column and a nitrogen-enriched vapor stream (containing less than 10 volume methane) is withdrawn from the top of the stripping column. The natural gas vapor stream from the phase separator or distillation vessel is expanded and cooled in separate heat exchangers and introduced into the top of the stripping column to provide reflux. Refrigeration to the additional heat exchangers is provided by vaporizing a portion of the bottoms liquid from the stripping column (thereby providing also boil-up from the column) and by warming the nitrogen-enriched vapor stream withdrawn from the top of the stripping column.

U.S. Pat. No. 8,522,574 discloses another process in which nitrogen is removed from liquefied natural gas. In this process, a natural gas feed stream is first cooled and liquefied in a main heat exchanger. The liquid stream is then cooled in a secondary heat exchanger and expanded into a flash vessel where a nitrogen-rich vapor is separated from a methane-rich liquid. The vapor stream is further expanded and sent to the top of a fractionation column. The liquid stream from the flash vessel is divided, with one portion being introducing into an intermediate location of the fractionation column, and another portion being warmed in the secondary heat exchanger and introduced into the bottom of the fractionation column. The nitrogen-rich overhead vapor obtained from the fractionation column is passed through and warmed in the secondary heat exchanger to provide additional refrigeration to said heat exchanger. Product liquefied natural gas is recovered from the bottom of the fractionation column.

US2012/019883 discloses a process for liquefying a natural gas stream and removing nitrogen from it. The natural gas feed stream is liquefied in a main heat exchanger, expanded and introduced into the bottom of a separating column. Refrigeration for the main heat exchanger is provided by a closed-loop refrigeration system circulating a mixed refrigerant. Nitrogen-depleted LNG withdrawn from the bottom of the separating column is expanded and further separated in a phase separator. The nitrogen-depleted LNG from the phase separator is sent to an LNG storage tank. The vapor stream from the phase separator is combined with boil off gas from the LNG storage tank, warmed in the main heat exchanger to provide additional refrigeration to the main heat exchanger, compressed, and recycled into the natural gas feed stream. The nitrogen-enriched vapor (90 to 100 volume % nitrogen) withdrawn from the top of the separating column is also warmed in the main heat exchanger to provide additional refrigeration to the main heat exchanger.

BRIEF SUMMARY

According to a first aspect of the present invention, there is provided a method for producing a nitrogen-depleted LNG product, the method comprising:

(a) passing a natural gas feed stream through a main heat exchanger to cool the natural gas feed stream and liquefy all or a portion of said stream, thereby producing a first LNG stream;

(b) withdrawing the first LNG stream from the main heat exchanger;

(c) expanding, partially vaporizing and separating the first LNG stream, or an LNG stream formed from part of the first LNG stream, to form a nitrogen-depleted LNG product and a recycle stream composed of nitrogen-enriched natural gas vapor;

(d) compressing the recycle stream to form a compressed recycle stream;

(e) passing the compressed recycle stream through the main heat exchanger, separately from and in parallel with the natural gas feed stream, to cool the compressed recycle stream and at least partially liquefy all or a portion thereof, thereby producing a first at least partially liquefied nitrogen-enriched natural gas stream;

(f) withdrawing the first at least partially liquefied nitrogen-enriched natural gas stream from the main heat exchanger; and (g) expanding, partially vaporizing and separating the first at least partially liquefied nitrogen-enriched natural gas stream to form a nitrogen-rich vapor product.

According to a second aspect of the present invention, there is provided an apparatus for producing a nitrogen-depleted LNG product, the apparatus comprising:

a main heat exchanger having cooling passages for receiving a natural gas feed stream and passing said stream through the heat exchanger to cool the stream and liquefy all or a portion of the stream so as to produce a first LNG stream, and for receiving a compressed recycle stream composed of nitrogen-enriched natural gas vapor and passing said stream through the heat exchanger to cool the stream and at least partially liquefy all or a portion of the stream so as to produce a first at least partially liquefied nitrogen-enriched natural gas stream, wherein said cooling passages are arranged so as to pass the compressed recycle stream through the heat exchanger separately from and in parallel with the natural gas feed stream;

a refrigeration system for supplying refrigerant to the main heat exchanger for cooling the cooling passages;

a first separation system, in fluid flow communication with the main heat exchanger, for receiving, expanding, partially vaporizing and separating the first LNG stream, or an LNG stream formed from part of the first LNG stream, to form a nitrogen-depleted LNG product and a recycle stream composed of nitrogen-enriched natural gas vapor;

a compressor, in fluid flow communication with the first separation system and main heat exchanger, for receiving the recycle stream, compressing the recycle stream to form the compressed recycle stream, and returning the compressed recycle stream to the main heat exchanger; and a second separation system, in fluid flow communication with the main heat exchanger, for receiving, expanding, partially vaporizing and separating the first at least partially liquefied nitrogen-enriched natural gas stream to form a nitrogen-rich vapor product.

Preferred aspects of the present invention include the following aspects, numbered #1 to #28:

#1. A method for producing a nitrogen-depleted LNG product, the method comprising:

(a) passing a natural gas feed stream through a main heat exchanger to cool the natural gas feed stream and liquefy all or a portion of said stream, thereby producing a first LNG stream;

(b) withdrawing the first LNG stream from the main heat exchanger;

(c) expanding, partially vaporizing and separating the first LNG stream, or an LNG stream formed from part of the first LNG stream, to form a nitrogen-depleted LNG product and a recycle stream composed of nitrogen-enriched natural gas vapor;

(d) compressing the recycle stream to form a compressed recycle stream;

(e) passing the compressed recycle stream through the main heat exchanger, separately from and in parallel with the natural gas feed stream, to cool the compressed recycle stream and at least partially liquefy all or a portion thereof, thereby producing a first at least partially liquefied nitrogen-enriched natural gas stream;

(f) withdrawing the first at least partially liquefied nitrogen-enriched natural gas stream from the main heat exchanger; and (g) expanding, partially vaporizing and separating the first at least partially liquefied nitrogen-enriched natural gas stream to form a nitrogen-rich vapor product.

#2. The method of Aspect #1, wherein step (c) comprises expanding the first LNG stream or LNG stream formed therefrom, transferring the expanded stream into an LNG storage tank in which a portion of the LNG vaporizes, thereby forming a nitrogen-enriched natural gas vapor and the nitrogen-depleted LNG product, and withdrawing nitrogen-enriched natural gas vapor from the tank to form the recycle stream.

#3. The method of Aspect #1 or #2, wherein step (g) comprises expanding and partially vaporizing the first at least partially liquefied nitrogen-enriched natural gas stream and separating said stream in a phase separator into vapor and liquid phases to form the nitrogen-rich vapor product and a second LNG stream.

#4. The method of Aspect #3, wherein step (c) comprises expanding, partially vaporizing and separating the first LNG stream to form the nitrogen-depleted LNG product and the recycle stream composed of nitrogen-enriched natural gas vapor, and wherein the method further comprises:

(h) expanding, partially vaporizing and separating the second LNG stream to produce additional nitrogen-enriched natural gas vapor for the recycle stream and additional nitrogen-depleted LNG product.

#5. The method of Aspect #1 or #2, wherein step (g) comprises expanding and partially vaporizing the first at least partially liquefied nitrogen-enriched natural gas stream, introducing said stream into a distillation column to separate the stream into vapor and liquid phases, and forming the nitrogen-rich vapor product from overhead vapor withdrawn from the distillation column.

#6. The method of Aspect #5, wherein step (c) comprises expanding, partially vaporizing and separating the first LNG stream to form the nitrogen-depleted LNG product and the recycle stream composed of nitrogen-enriched natural gas vapor.

#7. The method of Aspect #5, wherein:

step (c) comprises (i) expanding, partially vaporizing and separating the first LNG stream to form a nitrogen-depleted LNG stream and a stripping gas stream composed of nitrogen-enriched natural gas vapor and, and (ii) further expanding, partially vaporizing and separating the nitrogen-depleted LNG stream to form the nitrogen-depleted LNG product and the recycle stream composed of nitrogen-enriched natural gas vapor; and step (g) further comprises introducing the stripping gas stream into the bottom of the distillation column.

#8. The method of Aspect #6 or 7, wherein step (g) further comprises forming a second LNG stream from bottoms liquid withdrawn from the distillation column, and wherein the method further comprises:

(h) expanding, partially vaporizing and separating the second LNG stream to produce additional nitrogen-enriched natural gas vapor for the recycle stream and additional nitrogen-depleted LNG product.

#9. The method of Aspect #5, wherein step (c) comprises (i) expanding and partially vaporizing the first LNG stream and introducing said stream into the distillation column to separate the stream into vapor and liquid phases, the first LNG stream being introduced into the distillation column at a location below the location at which the first at least partially liquefied nitrogen-enriched natural gas stream is introduced into the column, (ii) forming a second LNG stream from bottoms liquid withdrawn from the distillation column, and (iii) expanding, partially vaporizing and separating the second LNG stream to form the nitrogen-depleted LNG product and the recycle stream composed of nitrogen-enriched natural gas vapor.

#10. The method of Aspect #9, wherein the first LNG stream is introduced into the distillation column at an intermediate location of the column, and boil-up for the distillation column is provided by heating and vaporizing a portion of the bottoms liquid in a reboiler heat exchanger via indirect heat exchange with the first LNG stream prior to introduction of the first LNG stream into the distillation column.

#11. The method of Aspect #9, wherein the first LNG stream is introduced into the bottom of the distillation column.

#12. The method of any one of Aspects #5 to #10, wherein boil-up for the distillation column is provided by heating and vaporizing a portion of the bottoms liquid in a reboiler heat exchanger via indirect heat exchange with all or a portion of the first at least partially liquefied nitrogen-enriched natural gas stream prior to the introduction of said stream into the distillation column.

#13. The method of any one of Aspects #5 to #12, wherein step (e) comprises introducing the compressed recycle stream into the main heat exchanger, cooling the compressed recycle stream, withdrawing a portion of the cooled compressed recycle stream from an intermediate location of the main heat exchanger to form a stripping gas stream, and further cooling and at least partially liquefying another portion of the cooled compressed recycle stream to form the first at least partially liquefied nitrogen-enriched natural gas stream; and wherein step (g) further comprises introducing the stripping gas stream into the bottom of the distillation column.

#14. The method of any one of Aspects #5 to #13, wherein the first at least partially liquefied nitrogen-enriched natural gas stream is introduced into the top of the distillation column.

#15. The method of any one of Aspects #5 to #13, wherein the first at least partially liquefied nitrogen-enriched natural gas stream is expanded, partially vaporized and separated into separate vapor and liquid streams prior to being introduced into the distillation column, the liquid stream being introduced into the distillation column at an intermediate location, and the vapor stream being cooled and at least partially condensed in a condenser heat exchanger, via indirect heat exchange with the overhead vapor withdrawn from the column, and then being introduced into the top of the column.

#16. The method of any one of Aspects #5 to #13, wherein reflux for the distillation column is provided by condensing a portion of the overhead vapor from the distillation column in a condenser heat exchanger.

#17. The method of Aspect #16, wherein refrigeration for the condenser heat exchanger is provided by warming overhead vapor withdrawn from the distillation column.

#18. The method of Aspect #16 or #17, wherein refrigeration for the condenser heat exchanger is provided by a closed loop refrigeration system that likewise provides refrigeration for the main heat exchanger, refrigerant circulated by the closed loop refrigeration system passing through and being warmed in the condenser heat exchanger.

#19. The method of any one of Aspects #1 to #18, wherein the method further comprises recycling a portion of the nitrogen-rich vapor product by adding said portion to the recycle stream obtained in step (c) prior to the compression of the recycle stream in step (d).

#20. The method of any one of Aspects #1 to #19, wherein the main heat exchanger comprises a warm end into which the natural gas feed stream and compressed recycle stream are introduced in parallel, and a cold end from which the first LNG stream and first at least partially liquefied nitrogen-enriched natural gas stream are withdrawn in parallel.

#21. The method of any one of Aspects #1 to #19, wherein the main heat exchanger comprises a warm end into which the natural gas feed stream is introduced, and a cold end from which the first LNG stream and first at least partially liquefied nitrogen-enriched natural gas stream are withdrawn in parallel, the compressed recycle stream being introduced into the main heat exchanger at an intermediate location between the warm and cold ends of the heat exchanger.

#22. The method of Aspect #21, wherein the recycle stream is heated in an economizer heat exchanger prior to being compressed in step (d), and wherein the compressed recycle stream is cooled in an aftercooler and further cooled in the economizer heat exchanger prior to being introduced into the main heat exchanger in step (e).

#23. The method of any one of Aspects #1 to #22, wherein the main heat exchanger comprises a warm end into which the natural gas feed stream is introduced, and a cold end from which the first LNG stream is withdrawn;

wherein step (a) comprises (i) introducing the natural gas feed stream into the warm end of the main heat exchanger, cooling and at least partially liquefying the natural gas feed stream, and withdrawing the cooled and at least partially liquefied stream from an intermediate location of the main heat exchanger, (ii) expanding, partially vaporizing and separating the cooled and at least partially liquefied stream to form a nitrogen-enriched natural gas vapor stream and a nitrogen-depleted natural gas liquid stream, and (iii) separately re-introducing the vapor and liquid streams into an intermediate location of the main heat exchanger and further cooling the vapor stream and liquid streams in parallel, the liquid stream being further cooled to form the first LNG stream and the vapor stream being further cooled and at least partially liquefied to form a second at least partially liquefied nitrogen-enriched natural gas stream; and wherein step (b) comprises withdrawing the first LNG stream and the second at least partially liquefied nitrogen-enriched natural gas stream from the cold end of the main heat exchanger.

#24. The method of Aspect #23 when dependent on any one of Aspects #1, #2 and #5 to #21, wherein step (g) comprises expanding and partially vaporizing the first at least partially liquefied nitrogen-enriched natural gas stream and the second at least partially liquefied nitrogen-enriched natural gas stream, introducing the streams into a distillation column to separate the streams into vapor and liquid phases, and forming the nitrogen-rich vapor product from overhead vapor withdrawn from the distillation column.

#25. The method of Aspect #24, wherein the first at least partially liquefied nitrogen-enriched natural gas stream is introduced into the distillation column at a location above the location at which the second at least partially liquefied nitrogen-enriched natural gas stream is introduced into the distillation column.

#26. The method of any one of Aspects #1 to #25, wherein refrigeration for the main heat exchanger is provided by a closed loop refrigeration system, refrigerant circulated by the closed loop refrigeration system passing through and being warmed in the main heat exchanger.

#27. An apparatus for producing a nitrogen-depleted LNG product, the apparatus comprising:

a main heat exchanger having cooling passages for receiving a natural gas feed stream and passing said stream through the heat exchanger to cool the stream and liquefy all or a portion of the stream so as to produce a first LNG stream, and for receiving a compressed recycle stream composed of nitrogen-enriched natural gas vapor and passing said stream through the heat exchanger to cool and at least partially liquefy the stream so as to produce a first at least partially liquefied nitrogen-enriched natural gas stream, wherein said cooling passages are arranged so as to pass the compressed recycle stream through the heat exchanger separately from and in parallel with the natural gas feed stream;

a refrigeration system for supplying refrigerant to the main heat exchanger for cooling the cooling passages;

a first separation system, in fluid flow communication with the main heat exchanger, for receiving, expanding, partially vaporizing and separating the first LNG stream, or an LNG stream formed from part of the first LNG stream, to form a nitrogen-depleted LNG product and a recycle stream composed of nitrogen-enriched natural gas vapor;

a compressor, in fluid flow communication with the first separation system and main heat exchanger, for receiving the recycle stream, compressing the recycle stream to form the compressed recycle stream, and returning the compressed recycle stream to the main heat exchanger; and a second separation system, in fluid flow communication with the main heat exchanger, for receiving, expanding, partially vaporizing and separating the first at least partially liquefied nitrogen-enriched natural gas stream to form a nitrogen-rich vapor product.

#28. An apparatus according to Aspect #27, wherein the refrigeration system is a closed loop refrigeration system, the first separation system comprises an expansion device and an LNG tank, and the second separation system comprises an expansion device and a phase separator or distillation column.

DETAILED DESCRIPTION

Figure 1:
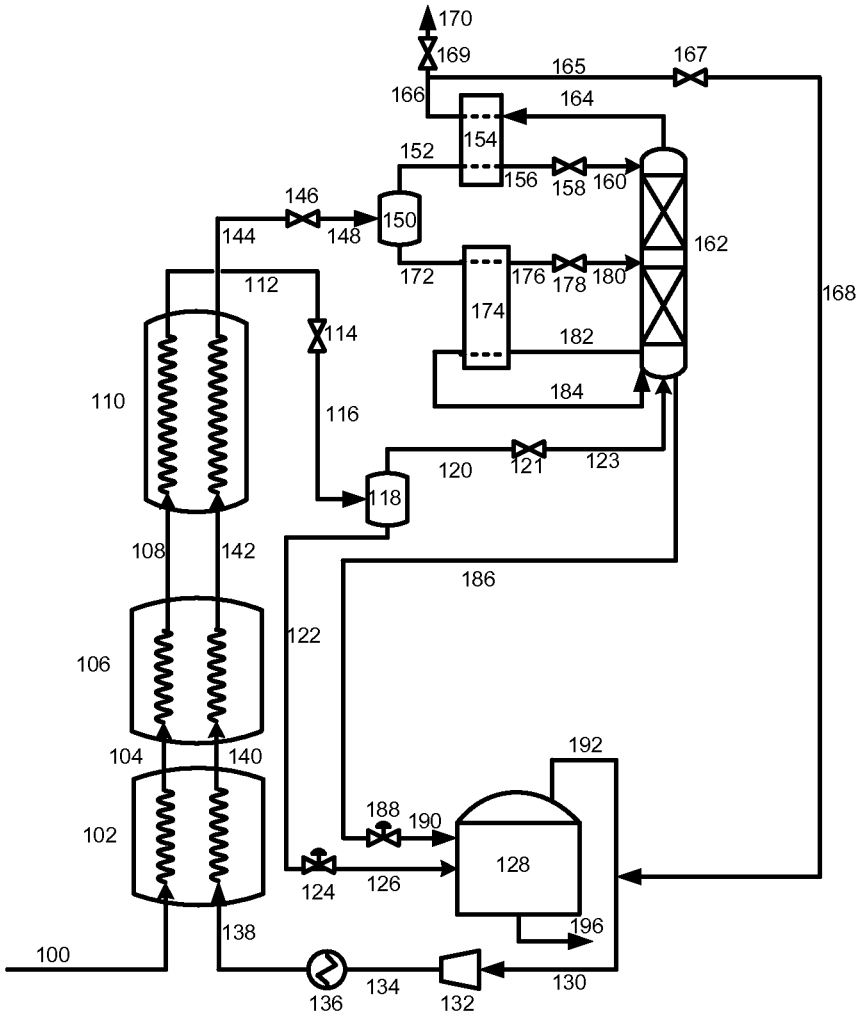
FIG. 1 is a schematic flow diagram depicting a method and apparatus according to one embodiment of the present invention, for liquefying and removing nitrogen from a natural gas stream to produce a nitrogen-depleted LNG product.

Unless otherwise indicated, the articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

As noted above, according to a first aspect of the present invention there is provided a method for producing a nitrogen-depleted LNG product comprising:

(a) passing a natural gas feed stream through a main heat exchanger to cool the natural gas feed stream and liquefy (and, typically, subcool) all or a portion of said stream, thereby producing a first LNG stream;

(b) withdrawing the first LNG stream from the main heat exchanger;

(c) expanding, partially vaporizing and separating the first LNG stream, or an LNG stream formed from part of the first LNG stream, to form a nitrogen-depleted LNG product and a recycle stream composed of nitrogen-enriched natural gas vapor;

(d) compressing the recycle stream to form a compressed recycle stream;

(e) passing the compressed recycle stream through the main heat exchanger, separately from and in parallel with the natural gas feed stream, to cool the compressed recycle stream and at least partially liquefy all or a portion thereof, thereby producing a first at least partially liquefied nitrogen-enriched natural gas stream;

(f) withdrawing the first at least partially liquefied nitrogen-enriched natural gas stream from the main heat exchanger; and (g) expanding, partially vaporizing and separating the first at least partially liquefied nitrogen-enriched natural gas stream to form a nitrogen-rich vapor product.

As used herein, the term "natural gas" encompasses also synthetic and substitute natural gases. The natural gas feed stream comprises methane and nitrogen (with methane typically being the major component). Typically the natural gas feed stream has nitrogen concentration of from 1 to 10 mol %, and the methods and apparatus described herein can effectively remove nitrogen from the natural gas feed stream even where the nitrogen concentration in the natural gas feed stream is relatively low, such as 5 mol % or below. The natural gas stream will usual also contain other components, such as for example one or more other hydrocarbons and/or other components such as helium, carbon dioxide, hydrogen, etc. However, it should not contain any additional components at concentrations that will freeze in the main heat exchanger during cooling and liquefaction of the stream. Accordingly, prior to being introduced into the main heat exchanger, the natural gas feed stream may be pretreated if and as necessary to remove water, acid gases, mercury and heavy hydrocarbons from the natural gas feed stream, so as to reduce the concentrations of any such components in the natural gas feed stream down to such levels as will not result in any freezing problems.

As used herein, and unless otherwise indicated, a stream is "nitrogen-enriched" if the concentration of nitrogen in the stream is higher than the concentration of nitrogen in the natural gas feed stream. A stream is "nitrogen-depleted" if the concentration of nitrogen in the stream is lower than the concentration of nitrogen in the natural gas feed stream. In the method according to the first aspect of the present invention as described above, the nitrogen-rich vapor product has a higher nitrogen concentration than the first at least partially liquefied nitrogen-enriched natural gas stream (and thus may be described as being further enriched in nitrogen, relative to the natural gas feed stream). Where the natural gas feed stream contains other components in addition to methane and nitrogen, streams that are "nitrogen-enriched" may also be enriched in other light components (e.g. other components having a boiling point similar to or lower than that of nitrogen, such as for example helium), and streams that are "nitrogen-depleted" may also be depleted in other heavy components (e.g. other components having a boiling point similar to or higher than that of methane, such as for example heavier hydrocarbons).

As used herein, the term "main heat exchanger" refers to the heat exchanger responsible for cooling and liquefying all or a portion of the natural gas stream to produce the first LNG stream. As is described below in more detail, the heat exchanger may be composed of one or more cooling sections arranged in series and/or in parallel. Each such sections may constitute a separate heat exchanger unit having its own housing, but equally sections may be combined into a single heat exchanger unit sharing a common housing. The heat exchanger unit(s) may be of any suitable type, such as but not limited to shell and tube, wound coil, or plate and fin types of heat exchanger unit. In such units, each cooling section will typically comprise its own tube bundle (where the unit is of the shell and tube or wound coil type) or plate and fin bundle (where the unit is of the plate and fin types). As used herein, the "warm end" and "cold end" of the main heat exchanger are relative terms, referring to the ends of the main heat exchanger that are of the highest and lowest temperature (respectively), and are not intended to imply any particular temperature ranges, unless otherwise indicated. The phrase "an intermediate location" of the main heat exchanger refers to a location between the warm and cold ends, typically between two cooling sections that are in series.

Typically, some or all of the refrigeration for the main heat exchanger is provided by a closed loop refrigeration system, refrigerant circulated by the closed loop refrigeration system passing through and being warmed in the main heat exchanger. The closed loop refrigeration system (or closed loop refrigeration systems, where more than one is used to provide refrigeration to the main heat exchanger) may be of any suitable type. Exemplary refrigeration systems, comprising one or more close loop systems, that may be used in accordance with the present invention include the single mixed refrigerant (SMR) system, the dual mixed refrigerant (DMR) system, the hybrid propane mixed refrigerant (C3MR) system, the nitrogen expansion cycle (or other gaseous expansion cycle) system, and the cascade refrigeration system.

In the methods and apparatus described herein, and unless otherwise indicated, streams may be expanded and/or, in the case of liquid or two-phase streams, expanded and partially vaporized by passing the stream through any suitable expansion device. A stream may, for example, be expanded and partially vaporized by being passed through an expansion valve or J-T valve, or any other device for effecting (essentially) isenthalpic expansion (and hence flash evaporation) of the stream. Additionally or alternatively, a stream may for example be expanded and partially vaporized by being passed and work expanded through a work-extracting device, such as for example a hydraulic turbine or turbo expander, thereby effecting (essentially) isentropic expansion of the stream.

In a preferred embodiment, step (c) of the method uses an LNG storage tank to separate the first LNG stream, or the LNG stream formed from part of the first LNG stream, to form the nitrogen-depleted LNG product and the recycle stream. Thus, step (c) preferably comprises expanding the first LNG stream or LNG stream formed therefrom, transferring the expanded stream into an LNG storage tank in which a portion of the LNG vaporizes, thereby forming a nitrogen-enriched natural gas vapor and the nitrogen-depleted LNG product, and withdrawing nitrogen-enriched natural gas vapor from the tank to form the recycle stream.

In one embodiment, step (g) of the method uses a phase separator to separate the first at least partially liquefied nitrogen-enriched natural gas stream to form a nitrogen-rich vapor product. Thus, step (g) may comprise expanding and partially vaporizing the first at least partially liquefied nitrogen-enriched natural gas stream and separating said stream in a phase separator into vapor and liquid phases to form the nitrogen-rich vapor product and a second LNG stream.

As used herein, the term "phase separator" refers to a device, such as drum or other form of vessel, in which a two phase stream can be introduced in order to separate the stream into its constituent vapor and liquid phases. In contrast to a distillation column (discussed below), the vessel does not contain any separation sections designed to effect mass transfer between countercurrent liquid and vapor flows inside the vessel. Where a stream is to be expanded (or expanded and partially vaporized) prior to being separated, the expansion device for expanding the stream and the phase separator for separating the stream may be combined into a single device, such as for example a flash drum (in which the inlet to the drum incorporates an expansion valve).

Where step (g) uses a phase separator as described above, step (c) of the method preferably comprises expanding, partially vaporizing and separating the first LNG stream (as opposed to an LNG stream formed from part of the first LNG stream) to form the nitrogen-depleted LNG product and the recycle stream composed of nitrogen-enriched natural gas vapor. The method may in addition further comprise the step (h) of expanding, partially vaporizing and separating the second LNG stream to produce additional nitrogen-enriched natural gas vapor for the recycle stream and additional nitrogen-depleted LNG product. In this and other embodiments where the second LNG stream is also expanded, partially vaporized and separated to produce additional nitrogen-enriched natural gas vapor and additional nitrogen-depleted LNG product, this step may be carried out by combining the first and second LNG streams and then expanding, partially vaporizing and separating the combined stream; by separately expanding and partially vaporizing the streams, combining the expanded streams, and then separating the combined stream; or by expanding, partially vaporizing and separating each stream individually.

In an alternative embodiment, step (g) of the method uses a distillation column to separate the first at least partially liquefied nitrogen-enriched natural gas stream to form a nitrogen-rich vapor product. Thus, step (g) may comprise expanding and partially vaporizing the first at least partially liquefied nitrogen-enriched natural gas stream, introducing said stream into a distillation column to separate the stream into vapor and liquid phases, and forming the nitrogen-rich vapor product from overhead vapor withdrawn from the distillation column.

As used herein, the term "distillation column" refers to a column (or set of columns) containing one or more separation sections, each separation section being composed of inserts, such as packing and/or one or more trays, that increase contact and thus enhance mass transfer between the upward rising vapor and downward flowing liquid flowing through the section inside the column. In this way, the concentration of lighter components (such as nitrogen) in the overhead vapor, i.e. the vapor that collects at the top of the column, is increased, and the concentration of heavier components (such as methane) in the bottoms liquid, i.e. the liquid that collects at the bottom of the column, is increased. The "top" of the column refers to the part of the column above the separation sections. The "bottom" of the column refers to the part of the column below the separation sections. An "intermediate location" of the column refers to a location between the top and bottom of the column, typically between two separation sections that are in series.

In those embodiments in which step (g) uses a distillation column as described above, step (c) of the method may comprise expanding, partially vaporizing and separating the first LNG stream to form the nitrogen-depleted LNG product and the recycle stream composed of nitrogen-enriched natural gas vapor. Step (g) may further comprise forming a second LNG stream from bottoms liquid withdrawn from the distillation column. The method may in addition further comprise the step (h) described above.

Alternatively, step (c) of the method may comprise (i) expanding, partially vaporizing and separating the first LNG stream to form a nitrogen-depleted LNG stream and a stripping gas stream composed of nitrogen-enriched natural gas vapor, and (ii) further expanding, partially vaporizing and separating the nitrogen-depleted LNG stream to form the nitrogen-depleted LNG product and the recycle stream composed of nitrogen-enriched natural gas vapor. Step (g) of the method may further comprise introducing the stripping gas stream into the bottom of the distillation column. Step (g) may further comprise forming a second LNG stream from bottoms liquid withdrawn from the distillation column. The method may in addition further comprise the step (h) described above.

Alternatively, step (c) of the method may comprise (i) expanding and partially vaporizing the first LNG stream and introducing said stream into the distillation column to separate the stream into vapor and liquid phases, the first LNG stream being introduced into the distillation column at a location below the location at which the first at least partially liquefied nitrogen-enriched natural gas stream is introduced into the column, (ii) forming a second LNG stream from bottoms liquid withdrawn from the distillation column, and (iii) expanding, partially vaporizing and separating the second LNG stream to form the nitrogen-depleted LNG product and the recycle stream composed of nitrogen-enriched natural gas vapor. The first LNG stream may be introduced into the distillation column at an intermediate location of the column. The first LNG stream may be introduced into the bottom of the distillation column.

Boil-up for the distillation column may be provided by heating and vaporizing a portion of the bottoms liquid in a reboiler heat exchanger via indirect heat exchange with the first LNG stream prior to introduction of the first LNG stream into the distillation column.

Boil-up for the distillation column may be provided by heating and vaporizing a portion of the bottoms liquid in a reboiler heat exchanger via indirect heat exchange with all or a portion of the first at least partially liquefied nitrogen-enriched natural gas stream prior to the introduction of said stream into the distillation column.

Boil-up for the distillation column may be provided by heating and vaporizing a portion of the bottoms liquid in a reboiler heat exchanger against an external heat source (for example such as, but not limited to, an electric heater).

Step (e) of the method may comprise introducing the compressed recycle stream into the main heat exchanger, cooling the compressed recycle stream, withdrawing a portion of the cooled compressed recycle stream from an intermediate location of the main heat exchanger to form a stripping gas stream, and further cooling and at least partially liquefying another portion of the cooled compressed recycle stream to form the first at least partially liquefied nitrogen-enriched natural gas stream. Step (g) may then further comprise introducing the stripping gas stream into the bottom of the distillation column.

Step (g) of the method may further comprise the introduction of a stripping gas stream, generated from any suitable source, into the bottom of the distillation column. In addition to the stripping gas streams generated from the sources described above, additional or alternative sources may include forming a stripping gas stream from a portion of the compressed recycle gas prior to the remaining compressed recycle gas being introduced as the stream of compressed recycle gas into the main heat exchanger; forming a stripping gas stream from a portion of cold natural gas feed stream withdrawn from an intermediate location of the main heat exchanger; and forming a stripping gas stream from a portion of the natural gas feed.

Preferably, the first at least partially liquefied nitrogen-enriched natural gas stream is introduced into the top of the distillation column, or into the distillation column at an intermediate location of the column.

The first at least partially liquefied nitrogen-enriched natural gas stream may be expanded, partially vaporized and separated into separate vapor and liquid streams prior to being introduced into the distillation column, the liquid stream being introduced into the distillation column at an intermediate location, and the vapor stream being cooled and at least partially condensed in a condenser heat exchanger, via indirect heat exchange with the overhead vapor withdrawn from the column, and then being introduced into the top of the column. The first at least partially liquefied nitrogen-enriched natural gas stream is preferably separated into the separate vapor and liquid streams in a phase separator. Where the first at least partially liquefied nitrogen-enriched natural gas stream is already a two-phase stream, minimal additional expansion and vaporization of the stream may be needed, in which case it may not be necessary to pass the stream through an expansion device before introducing the stream into the phase separator (any expansion and vaporization needed being effected by the expansion and vaporization that will inevitably occur on introduction of a two-phase stream into a drum or other such vessel).

Reflux for the distillation column may be provided by condensing a portion of the overhead vapor from the distillation column in a condenser heat exchanger. Refrigeration for the condenser heat exchanger may be provided by warming overhead vapor withdrawn from the distillation column. Refrigeration for the condenser heat exchanger may be provided by a closed loop refrigeration system that likewise provides refrigeration for the main heat exchanger, refrigerant circulated by the closed loop refrigeration system passing through and being warmed in the condenser heat exchanger.

The method in accordance with the first aspect of the invention (including any of the embodiments thereof described above) may further comprise recycling a portion of the nitrogen-rich vapor product by adding said portion to the recycle stream obtained in step (c) prior to the compression of the recycle stream in step (d).

In some embodiments, the natural gas feed stream and compressed recycle stream may be introduced in parallel into the warm end of the main heat exchanger, and first LNG stream and first at least partially liquefied nitrogen-enriched natural gas stream may be withdrawn in parallel from the cold end of the main heat exchanger.

In other embodiments, the natural gas feed stream may be introduced into the warm end of the main heat exchanger, the compressed recycle stream may be introduced into an intermediate location of the main heat exchanger and the first LNG stream and first at least partially liquefied nitrogen-enriched natural gas stream may be withdrawn in parallel from the cold end of the main heat exchanger. In these embodiments, the recycle stream may be heated in an economizer heat exchanger prior to being compressed in step (d) of the method, and the compressed recycle stream may be cooled in an aftercooler and further cooled in the economizer heat exchanger prior to being introduced into the main heat exchanger in step (e) of the method.

In some embodiments, steps (a) and (b) of the method may comprise (i) introducing the natural gas feed stream into the warm end of the main heat exchanger, cooling and at least partially liquefying the natural gas feed stream, and withdrawing the cooled and at least partially liquefied stream from an intermediate location of the main heat exchanger, (ii) expanding, partially vaporizing and separating the cooled and at least partially liquefied stream to form a nitrogen-enriched natural gas vapor stream and a nitrogen-depleted natural gas liquid stream, (iii) separately re-introducing the vapor and liquid streams into an intermediate location of the main heat exchanger and further cooling the vapor stream and liquid streams in parallel, the liquid stream being further cooled to form the first LNG stream and the vapor stream being further cooled and at least partially liquefied to form a second at least partially liquefied nitrogen-enriched natural gas stream; and withdrawing the first LNG stream and the second at least partially liquefied nitrogen-enriched natural gas stream from the cold end of the main heat exchanger.

In the embodiments described in the above paragraph, step (g) of the method may comprise expanding and partially vaporizing the first at least partially liquefied nitrogen-enriched natural gas stream and the second at least partially liquefied nitrogen-enriched natural gas stream, introducing the streams into a distillation column to separate the streams into vapor and liquid phases, and forming the nitrogen-rich vapor product from overhead vapor withdrawn from the distillation column. The first at least partially liquefied nitrogen-enriched natural gas stream may be introduced into the distillation column at a location above the location at which the second at least partially liquefied nitrogen-enriched natural gas stream is introduced into the distillation column.

Also as noted above, according to a second aspect of the present invention there is provided an apparatus for producing a nitrogen-depleted LNG product, the apparatus comprising:

a main heat exchanger having cooling passages for receiving a natural gas feed stream and passing said stream through the heat exchanger to cool the stream and liquefy all or a portion of the stream so as to produce a first LNG stream, and for receiving a compressed recycle stream composed of nitrogen-enriched natural gas vapor and passing said stream through the heat exchanger to cool and at least partially liquefy the stream so as to produce a first at least partially liquefied nitrogen-enriched natural gas stream, wherein said cooling passages are arranged so as to pass the compressed recycle stream through the heat exchanger separately from and in parallel with the natural gas feed stream;

a refrigeration system for supplying refrigerant to the main heat exchanger for cooling the cooling passages;

a first separation system, in fluid flow communication with the main heat exchanger, for receiving, expanding, partially vaporizing and separating the first LNG stream, or an LNG stream formed from part of the first LNG stream, to form a nitrogen-depleted LNG product and a recycle stream composed of nitrogen-enriched natural gas vapor;

a compressor, in fluid flow communication with the first separation system and main heat exchanger, for receiving the recycle stream, compressing the recycle stream to form the compressed recycle stream, and returning the compressed recycle stream to the main heat exchanger; and a second separation system, in fluid flow communication with the main heat exchanger, for receiving, expanding, partially vaporizing and separating the first at least partially liquefied nitrogen-enriched natural gas stream to form a nitrogen-rich vapor product.

As used herein, the term "fluid flow communication" indicates that the devices or systems in question are connected to each other in such a way that the streams that are referred to can be sent and received by the devices or systems in question. The devices or systems may, for example be connected, by suitable tubes, passages or other forms of conduit for transferring the streams in question.

The apparatus according to the second aspect of the invention is suitable for carrying out a method in accordance with the first aspect of the invention. Thus, various preferred or optional features and embodiments of apparatus in accordance with the second aspect will be apparent from the preceding discussion of the various preferred or optional embodiments and features of the method in accordance with the first aspect. For example, in the apparatus according to the second aspect, the refrigeration system preferably comprises a closed loop refrigeration system. The first separation system preferably comprises an expansion device and an LNG tank. The second separation system may comprise an expansion device and a phase separator, an expansion device and a distillation column, or some combination thereof.

Solely by way of example, various preferred embodiment of the invention will now be described with reference to FIGS. 1 to 11. In these Figures, where a feature is common to more than one Figure that feature has been assigned the same reference numeral in each Figure, for clarity and brevity.

Referring to FIG. 1, a method and apparatus according to one embodiment of the present invention, for liquefying and removing nitrogen from a natural gas stream to produce a nitrogen-depleted LNG product, is shown.

Natural gas feed stream 100 is first passed through a cooling passage or set of cooling passages in a main heat exchanger to cool, liquefy and (typically) sub-cool the natural gas feed stream, thereby producing a first LNG stream 112. The natural gas feed stream comprises methane and nitrogen. Typically the natural gas feed stream has nitrogen concentration of from 1 to 10 mol %, and the methods and apparatus described herein can effectively remove nitrogen from the natural gas even where the nitrogen concentration in the natural gas feed stream is relatively low, such as 5 mol % or below. As is well known in the art, the natural gas feed stream should not contain any additional components at concentrations that will freeze in the main heat exchanger during cooling and liquefaction of the stream. Accordingly, prior to being introduced into the main heat exchanger, the natural gas feed stream may be pretreated if and as necessary to remove water, acid gases, mercury and heavy hydrocarbons from the natural gas feed stream, so as to reduce the concentrations of any such components in the natural gas feed stream down to such levels as will not result in any freezing problems. Appropriate equipment and techniques for effecting dehydration, acid-gas removal, mercury removal and heavy hydrocarbon removal are well known. The natural gas stream must also be at above-ambient pressure, and thus may be compressed and cooled if and as necessary in one or more compressors and aftercoolers (not shown) prior to being introduced into the main heat exchanger.

In the embodiment depicted in FIG. 1, the main heat exchanger is composed of three cooling sections in series, namely, a warm section 102 in which the natural gas feed stream 100 is pre-cooled, a middle or intermediate section 106 in which the cooled natural gas feed stream 104 is liquefied, and a cold section 110 in which the liquefied natural gas feed stream 108 is sub-cooled, the end of warm section 102 into which the natural gas feed stream 100 is introduced therefore constituting the warm end of the main heat exchanger, and the end of the cold section 110 from which the first LNG stream 112 is withdrawn therefore constituting the cold end of the main heat exchanger. As will be recognized, the terms 'warm' and 'cold' in this context refer only to the relative temperatures inside the cooling sections, and do not imply any particular temperature ranges. In the arrangement depicted FIG. 1, each of these sections constitutes a separate heat exchanger unit having its own shell, casing or other form of housing, but equally two or all three of the sections could be combined into a single heat exchanger unit sharing a common housing. The heat exchanger unit(s) may be of any suitable type, such as but not limited to shell and tube, wound coil, or plate and fin types of heat exchanger unit. In such units, each cooling section will typically comprise its own tube bundle (where the unit is of the shell and tube or wound coil type) or plate and fin bundle (where the unit is of the plate and fin types).

Some or all of the refrigeration for the main heat exchanger may be provided by any suitable closed loop refrigeration system (not shown). Exemplary refrigeration systems that may be used include a single mixed refrigerant (SMR) system, a dual mixed refrigerant (DMR) system, a hybrid propane mixed refrigerant (C3MR) system, a nitrogen expansion cycle (or other gaseous expansion cycle) system, and a cascade refrigeration system. In the SMR and nitrogen expansion cycle systems, refrigeration is supplied to all three sections 102, 106, 110 of the main heat exchanger by a single mixed refrigerant (in the case of the SMR system) or by nitrogen (in the case of the nitrogen expansion cycle system) circulated by a closed loop refrigeration system. In the DMR and C3MR systems, two separate closed loop refrigeration systems circulating two separate refrigerants (two different mixed refrigerants in the case of the DMR system, and a propane refrigerant and mixed refrigerant in the case of the C3MR system) are used to supply refrigerant to the main heat exchanger, such that different sections of the main heat exchanger may be cooled by different closed loop systems. The operation of SMR, DMR, C3MR, nitrogen expansion cycle and other such closed loop refrigeration systems are well known.

The first (sub-cooled) LNG stream 112 withdrawn from the cold end of the main heat exchanger is then expanded, partially vaporized and separated to form a nitrogen-depleted (and hence methane enriched) LNG stream 122 and a stripping gas stream 120 composed of nitrogen-enriched natural gas vapor. Stream 120 is referred to herein as a stripping gas stream because this stream is used to provide stripping gas to a distillation column, as will be described in further detail below. In the arrangement depicted in FIG. 1, the first LNG stream 112 is expanded, partially vaporized and separated by passing the stream through a J-T (Joule-Thomson) valve 114 into a phase separator 118. However, any alternative type of expansion device, such as a work-extracting device (e.g. hydraulic turbine or turbo expander), and other forms of separation device could equally be used.

Nitrogen-depleted LNG stream 122 is then further expanded, for example by passing the stream through a J-T valve 124 or turbo-expander (not shown), to form an expanded nitrogen-depleted LNG stream 126 that is introduced into an LNG storage tank 128. Inside the LNG storage tank 128 a portion of the LNG vaporizes, as a result of the initial expansion and introduction of the LNG into the tank and/or as a result ambient heating over time (since the storage tank cannot be perfectly insulated), producing a nitrogen enriched natural gas vapor that collects in and is withdrawn from the headspace of the tank as recycle stream 192, 130, and leaving behind a nitrogen-depleted LNG product that is stored in the tank and can be withdrawn as product stream 196. In an alternative embodiment (not depicted), LNG storage tank 128 could be replaced with a phase separator (such as a flash drum) or other form of separation device in which the expanded, nitrogen-depleted LNG stream 122 is separated into liquid a vapor phases forming, respectively, the nitrogen depleted LNG product 196 and recycle stream 192, 130 composed of nitrogen enriched natural gas vapor. In the case where an LNG storage tank is used, the nitrogen enriched natural gas vapor that collects in and is withdrawn from the headspace of the tank may also be referred to as a tank flash gas (TFG) or boil-off gas (BOG). In the case where a phase separator is used, the nitrogen enriched natural gas vapor that is formed in and withdrawn from the phase separator may also be referred to as an end-flash gas (EFG).

The recycle stream 192, 130 composed of nitrogen enriched natural gas vapor is then recompressed in one or more compressors 132 and cooled in one or more aftercoolers 136 to form a compressed recycle stream 138 that is recycled to the main heat exchanger (hence the reason for this stream being referred to as a recycle stream). The aftercoolers may use any suitable form of coolant, such as for example water or air at ambient temperature. The compressed recycle stream 138, as a result of being cooled in aftercooler(s) 136, is at approximately the same temperature (e.g. ambient) as the natural gas feed stream 100, but it is not added to and mixed with the natural gas feed stream. Rather, the compressed recycle stream is introduced separately into the warm end of the main heat exchanger and is passed through a separate cooling passage or set of cooling passages, that run parallel to the cooling passages in which the natural gas feed stream is cooled, so as to separately cool the compressed recycle stream in the warm, middle and cold sections 102, 106 and 110 of the main heat exchanger, the compressed recycle stream being cooled and at least partially liquefied to form a first at least partially liquefied (i.e. a partially or fully liquefied) nitrogen-enriched natural gas stream 144.

The first at least partially liquefied nitrogen-enriched natural gas stream 144 is withdrawn from the cold end of the main heat exchanger, and is then expanded, partially vaporized and introduced into a distillation column 162 in which it is separated into vapor and liquid phases. More specifically, the first at least partially liquefied nitrogen-enriched natural gas stream 144 is expanded, for example through a J-T valve 146 or turbo-expander (not shown), partially vaporized and separated in a phase separator 150 into separate vapor 152 and liquid 172 streams. The vapor stream 152 is cooled and at least partially condensed in a heat exchanger 154, further expanded in expansion device (such as J-T valve) 158, and introduced as stream 160 into the distillation column 162 for separation into liquid and vapor phases. The liquid stream 172 is cooled in a reboiler heat exchanger 174, further expanded in expansion device (such as J-T valve) 178, and introduced as stream 180 into the distillation column 162 for separation into liquid and vapor phases.

In the embodiment depicted in FIG. 1, the distillation column 162 comprises two separation sections, each composed of inserts such as packing and/or one or more trays to increase contact and thus enhance mass transfer between the upward rising vapor and downward flowing liquid inside the column. The cooled and further expanded stream 180 formed from the liquid portion of the first at least partially liquefied nitrogen-enriched natural gas stream 144 is introduced into the distillation column 162 at an intermediate location of the column, between the two separation sections. The cooled, at least partially condensed and further expanded vapor stream 160 formed from the vapor portion of the first at least partially liquefied nitrogen-enriched natural gas stream 144 is introduced into the top of distillation column 162, above both separation sections, providing reflux for the column. The stripping gas stream 120 separated, as described above, from the first LNG stream 112 in phase separator 118 is also introduced into the distillation column 162, at the bottom of the column, thus providing stripping gas for the column. Boil-up, and thus additional stripping gas, for the column is also provided by warming and vaporizing a portion 182 of the bottoms liquid from the column in reboiler heat exchanger 174 (via indirect heat exchange with the liquid portion 172 of the first at least partially liquefied nitrogen-enriched natural gas stream 144) and returning the vaporized bottoms liquid 184 to the bottom of the distillation column.

The overhead vapor from the distillation column 162 is further enriched in nitrogen (i.e. it is enriched in nitrogen relative to the first at least partially liquefied nitrogen-enriched natural gas stream 144, and thus further enriched in nitrogen relative to the natural gas feed stream 100) and is withdrawn from the top of the distillation column 162 as a nitrogen-rich vapor product stream 164. This stream is warmed in heat exchanger 154 (via indirect heat exchange with the vapor portion 152 of the first at least partially liquefied nitrogen-enriched natural gas stream 144) to provide a warmed nitrogen-rich vapor product stream 166 that passes through control valve 169 (which controls the operating pressure of the distillation column) to form the final nitrogen-rich vapor product stream 170. Depending on the nitrogen concentration in the feed stream 100 and the specifications from nitrogen-rich product, a portion 165, 168 of the warmed nitrogen-rich product stream 166 may be recycled by being combined with the recycle stream 192, so as to adjust and maintain a steady nitrogen concentration level in the recycle stream 130, offsetting fluctuations of the natural gas feed composition, the amount of the warmed nitrogen-rich product stream 166 that is recycled being controlled by valve 167. The benefit of having stream 165 and the valve 167 is that they enable stable operation of the liquefaction system and the distillation column to be maintained when feed gas composition or flow fluctuates. The final nitrogen-rich vapor product stream 170 can be further warmed by heat integration with other refrigerant streams to recover refrigeration (not shown).

The remainder of the bottoms liquid from the distillation column, that is not warmed and vaporized in reboiler heat exchanger 174, is withdrawn from the bottom of the distillation column forming a second LNG stream 186. The second LNG stream 186 is then expanded, for example by passing the stream through a J-T valve 188 or turbo-expander (not shown), to form an expanded stream 190 of approximately the same pressure as the expanded nitrogen-depleted LNG stream 126 formed from the first LNG stream 112. The expanded second LNG stream is likewise introduced into the LNG storage tank 188 in which, as described above, a portion of the LNG vaporizes, providing nitrogen enriched natural gas vapor that is withdrawn from the headspace of the tank as recycle stream 192, 130, and leaving behind a nitrogen-depleted LNG product that is stored in the tank and can be withdrawn as product stream 196. In this way, the second LNG stream 186 and the nitrogen-depleted LNG stream 122 formed from the first LNG stream 112 are expanded, combined and together separated into the recycle stream 192, 130 and the LNG product 196. However, in an alternative embodiment (not depicted), the second LNG stream 186 and the nitrogen-depleted LNG stream 122 formed from the first LNG stream 112 could be expanded and introduced into different LNG storage tanks (or other forms of separation system) to produce separate recycle streams that are then combined, and separate LNG product streams. Equally, in yet another embodiment (not depicted), the second LNG stream 186 and the nitrogen-depleted LNG stream 122 could (if of or adjusted to a similar pressure) be combined prior to being expanded through a J-T valve, turbo-expander or other form of expansion device, and then the combined expanded stream introduced into the LNG storage tank (or other form of separation system).

In the embodiment depicted in FIG. 1, the methane content in the final nitrogen product 170 can reach less than 1 mol %, and the LNG product stored in and withdrawn from in the LNG tank contains less than 1 mol % nitrogen. The embodiment therefore provides an simple and efficient means of liquefying natural gas and removing nitrogen to produce both high purity LNG product and a high purity nitrogen stream that can be vented while meeting environmental purity requirements, and without resulting in significant loss of methane. In particular, the use of the main heat exchanger to cool and at least partially liquefy the recycle stream, in parallel with but separately from the natural gas feed, provides distinct advantages. The vapor, such as BOG/TFG/EFG or the like, that is separated in the production of the final, nitrogen-depleted LNG product, and that in the present invention forms the recycle stream, still contains significant amounts of both nitrogen and methane that are desirably recovered. This could be achieved, as done in some prior art processes, by recycling the BOG/TFG/EFG back into the natural gas feed itself. However, the recycle stream is enriched in nitrogen compared to the natural gas feed stream, and so liquefying or partially liquefying this stream separately from the natural gas feed and then separating the resulting at least partially condensed nitrogen-enriched stream provides for a more efficient process of separating the nitrogen and methane components of the recycle stream than if the recycle stream were to be recycled back into and separated together with the natural gas feed stream. Additional benefits of keeping the recycle stream separate from the natural gas feed stream include that the recycle stream does not have to be compressed to the same pressure as the feed, and does not have to go through any natural gas feed pretreatment systems (thus reduce the load on any such systems). Equally, whilst the recycle stream could be cooled and at least partially liquefied by adding a dedicated heat exchanger and refrigeration system for doing this, using the main heat exchanger and its associated existing refrigeration system to cool and at least partially liquefy the recycle stream, so that this can then be separated into the nitrogen rich product and additional LNG product, provides for a more compact and cost efficient process and apparatus.

Referring now to FIGS. 2 to 10, these depict various further methods and apparatus for liquefying and removing nitrogen from a natural gas stream to produce a nitrogen-depleted LNG product according to alternative embodiments of the present invention.

Figure 2:
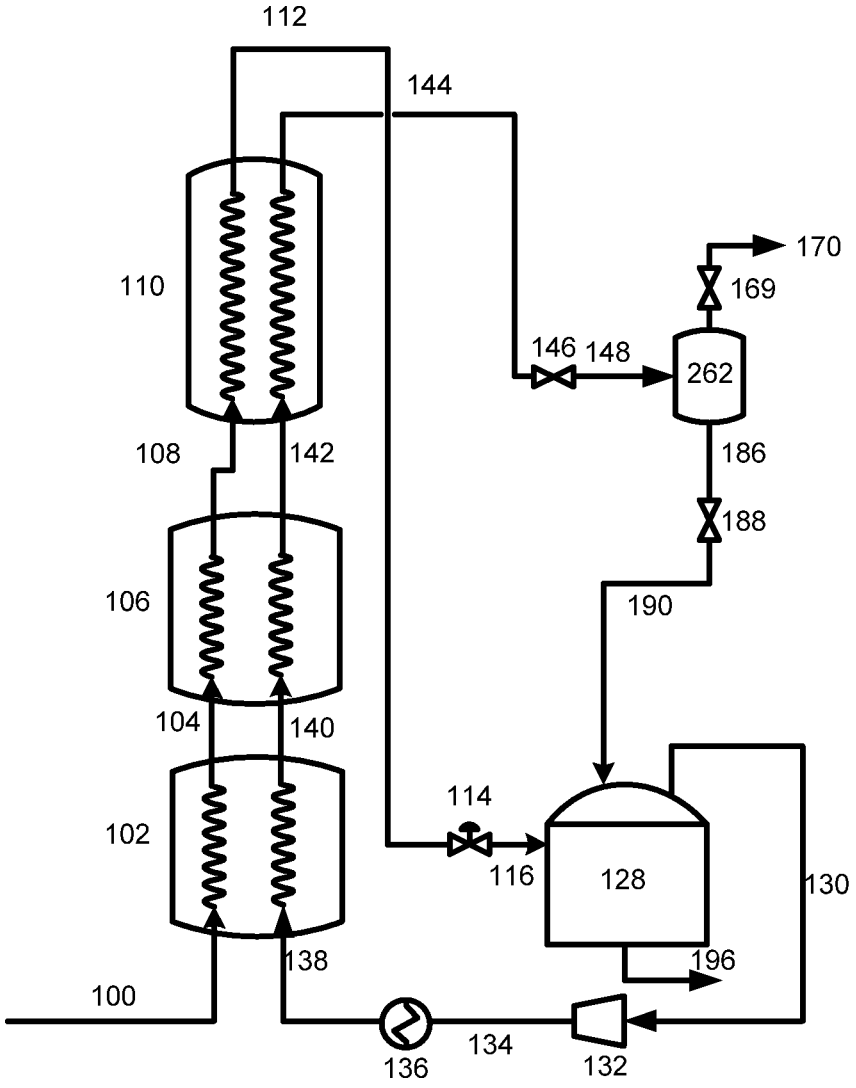
FIG. 2 is a schematic flow diagram depicting a method and apparatus according to another embodiment of the present invention.

The method and apparatus depicted in FIG. 2 differs from that depicted in FIG. 1 in that the first at least partially liquefied nitrogen-enriched natural gas stream 144 withdrawn from the cold end of the main heat exchanger is separated in a phase separator, rather than in a distillation column, into vapor and liquid phases to form the nitrogen rich vapor product and second LNG stream. More specifically, the first at least partially liquefied nitrogen-enriched natural gas stream 144 is expanded, for example through a J-T valve 146 or turbo-expander (not shown), partially vaporized and separated in phase separator 262 to form nitrogen rich vapor product 170 and second LNG stream 186. In addition, as the first at least partially liquefied nitrogen-enriched natural gas stream 144 is separated in a phase separator rather than a distillation column, there is no benefit to generating a stripping gas stream from the first LNG stream 112 withdrawn from the cold end of the main heat exchanger, and accordingly the first LNG stream 112 is expanded, for example by passing the stream through a J-T valve 114 or turbo-expander (not shown), and the expanded nitrogen-depleted LNG stream 116 is introduced directly into the LNG storage tank 128, into which the expanded second LNG stream 190 is also introduced, and from which the nitrogen-depleted LNG product 196 and recycle stream 130 are withdrawn.

Figure 3:
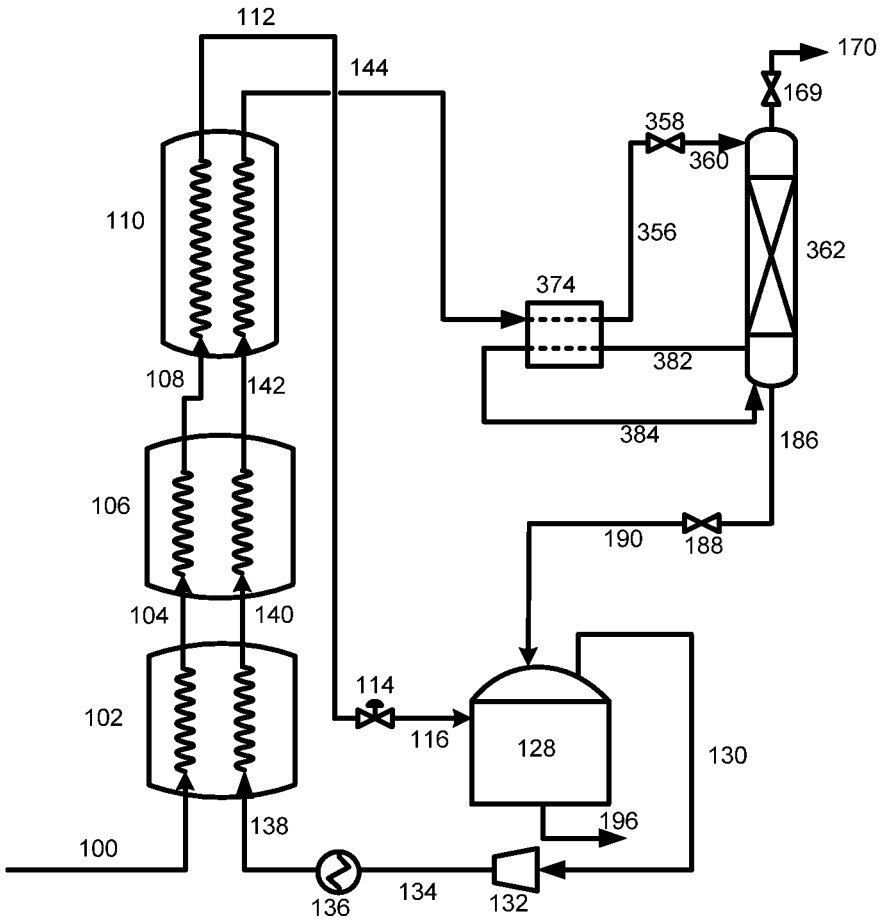
FIG. 3 is a schematic flow diagram depicting a method and apparatus according to another embodiment of the present invention.

The method and apparatus depicted in FIG. 3 differs from that depicted in FIG. 1 in that the first at least partially liquefied nitrogen-enriched natural gas stream 144 withdrawn from the cold end of the main heat exchanger is not separated into separate vapor and liquid streams before being introduced into and separated in the distillation column into vapor and liquid phases to form the nitrogen rich vapor product and second LNG stream, and in that no stripping gas is obtained from the first LNG stream 112 withdrawn from the cold end of the main heat exchanger. Thus, in this method and apparatus the first at least partially liquefied nitrogen-enriched natural gas stream 144 is cooled in a reboiler heat exchanger 374, expanded and partially vaporized, for example through J-T valve 358 or a turbo-expander (not shown), and introduced as cooled, expanded and partially vaporized stream 360 into distillation column 362 for separation into liquid and vapor phases. The distillation column 362 in this case comprises a single separation section. The cooled, expanded and partially vaporized stream 360 is introduced into the top of distillation column 162, above the separation section, providing reflux for the column. Boil-up for the column is provided by warming and vaporizing a portion 382 of the bottoms liquid from the column in the reboiler heat exchanger 374. The remainder of the bottoms liquid is withdrawn from the bottom of the distillation column forming a second LNG stream 186. The first LNG stream 112 and the second LNG stream 186 are expanded, for example by passing the streams through J-T valves 114, 188 or turbo-expanders (not shown), and introduced into the LNG storage tank 128, from which the nitrogen-depleted LNG product 196 and the recycle stream 130 are withdrawn. In an alternative embodiment (not shown), additional or alternative heat sources could be used to supply heat to the reboiler heat exchanger 374. For example, an external heat source (such as an electric heater) could be used in place of or in addition to cooling the first at least partially liquefied nitrogen-enriched natural gas stream 144 in the reboiler heat exchanger.

Figure 4:
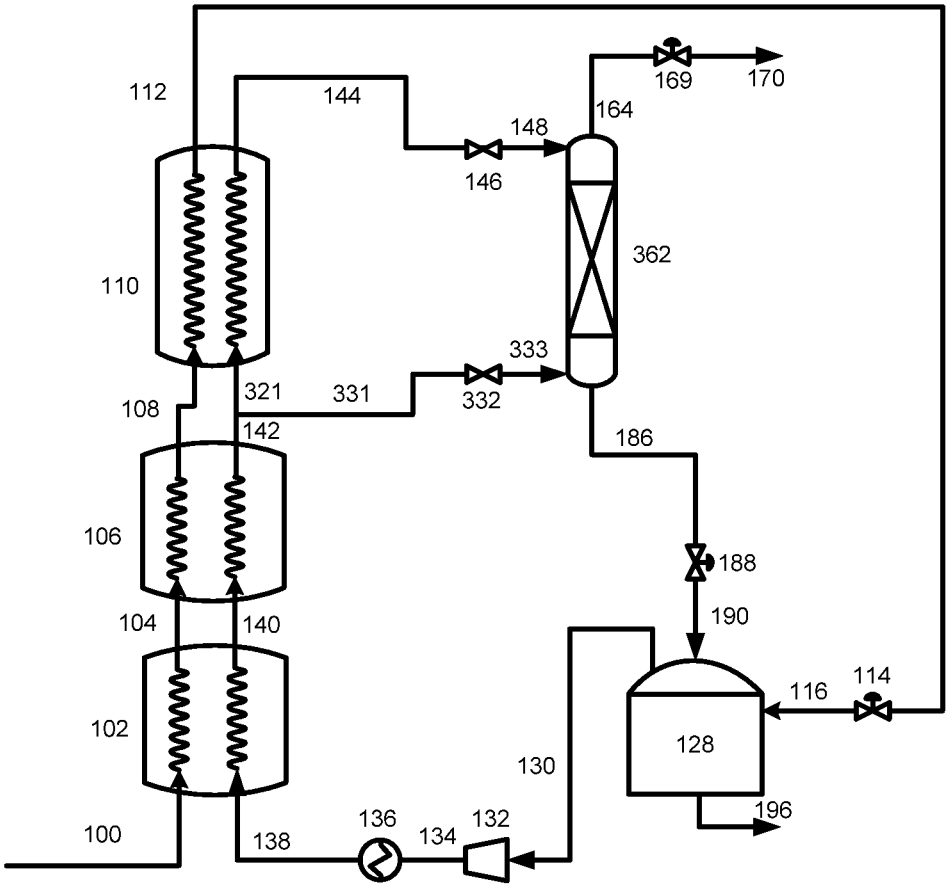
FIG. 4 is a schematic flow diagram depicting a method and apparatus according to another embodiment of the present invention.

The method and apparatus depicted in FIG. 4 differs from that depicted in FIG. 3 in that no reboiler heat exchanger 374 providing boil up to the distillation column 362 is used. Instead, stripping gas for the distillation column 362 is provided by a stream of stripping gas 331 formed from a portion of the cooled compressed recycle stream 142 withdrawn from an intermediate location of the main heat exchanger. More specifically, in the embodiment depicted in FIG. 4 the compressed recycle stream 138 is, as before, introduced into the warm end of the main heat exchanger and cooled in the warm 102 and middle 106 sections of the main heat exchanger to form a cooled compressed recycle stream 142 (which preferably at this stage is still at least predominantly all vapor). This stream 142 is then divided, with a portion being withdrawn from the main heat exchanger to form the stripping gas stream 331, and the remainder 321 of the stream being further cooled and at least partially liquefied in the cold section 110 of the main heat exchanger to form the first at least partially liquefied nitrogen-enriched natural gas stream 144 that is withdrawn from the cold end of the main heat exchanger. The stripping gas stream 331 is then expanded, for example through a J-T valve 332 or a turbo-expander (not shown), and introduced as stream 333 into the bottom of the distillation column 362, thereby providing stripping gas to the column. The first at least partially liquefied nitrogen-enriched natural gas stream 144 is expanded and partially vaporized, for example through J-T valve 146 or a turbo-expander (not shown), and introduced as expanded and partially vaporized stream 348 into the top of the distillation column 362, for separation into liquid and vapor phases and thereby providing also reflux for the column.

It should also be noted that alternative embodiments (not shown), a stripping gas for the distillation column for the distillation column could additionally or alternatively be generated from other locations and/or process streams. For example, depending on process conditions, a stripping gas stream could additionally or alternatively be taken: from the cooled compressed recycle stream 140 between the warm 102 and middle 106 sections of the main heat exchanger; form the compressed recycle gas exiting aftercooler 136 (the remainder of said gas then forming the compressed recycle stream 138 that is introduced into the warm end of the main heat exchanger); from the cold natural gas feed stream 108 (if still vapor) between the middle 106 and cold 110 sections of the main heat exchanger; or from the natural gas feed (the remainder of the feed then forming the natural gas feed stream 100 that is introduced into the warm end of the main heat exchanger).

Figure 5:
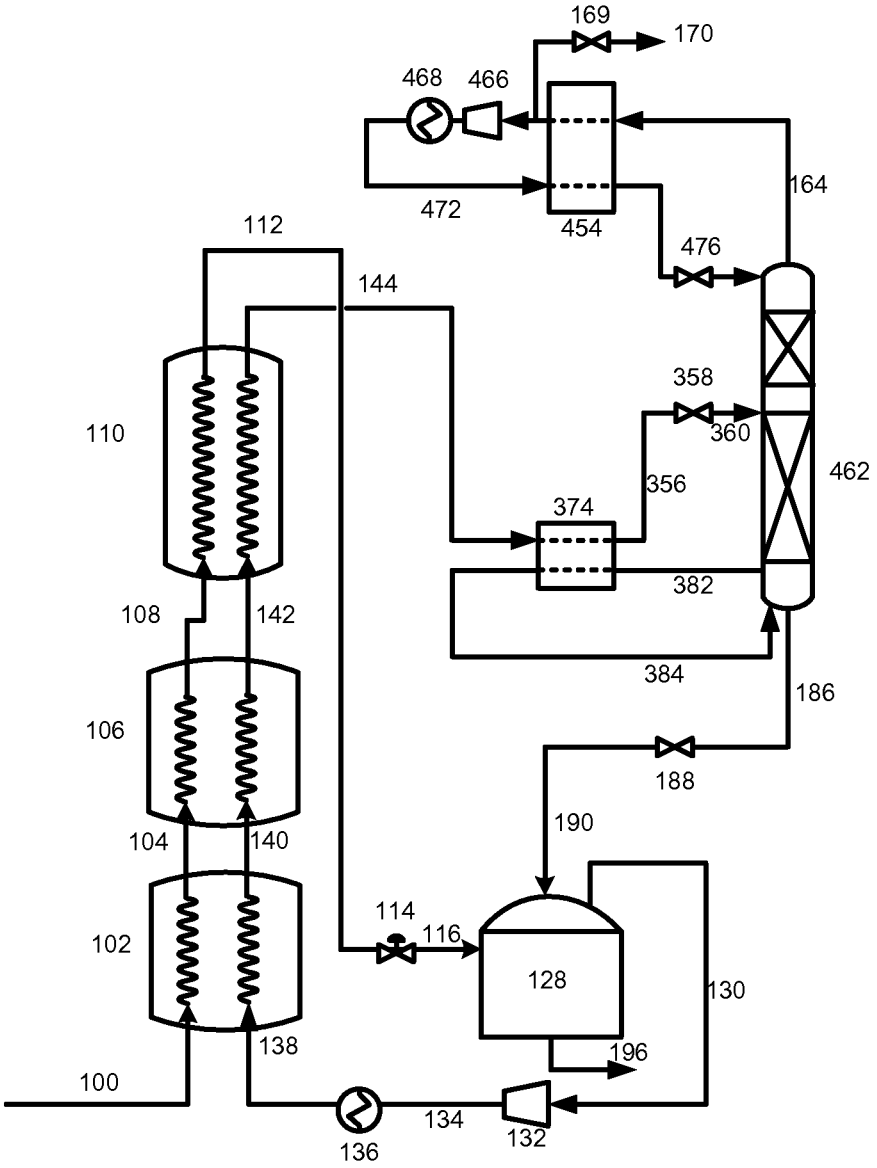
FIG. 5 is a schematic flow diagram depicting a method and apparatus according to another embodiment of the present invention.

The method and apparatus depicted in FIG. 5 differs from that depicted in FIG. 3 in that the distillation column 462 has two separation sections, and the cooled, expanded and partially vaporized stream 360 is introduced into the distillation column 462 at an intermediate location of the column, between the two separation sections. Reflux for the distillation column is provided by condensing a portion of the overhead vapor from the distillation column in a condenser heat exchanger. More specifically, the overhead vapor 164 withdrawn from the top of the distillation column 462 is first warmed in condenser heat exchanger 454. A portion of the warmed overhead is then compressed in compressor 466, cooled in aftercooler 468 (using coolant such as, for example, air or water at ambient temperature), further cooled and at least partially liquefied in condenser heat exchanger 454, expanded, for example through a J-T valve 476, and returned to the top of distillation column 462 providing reflux. The remainder of the warmed overhead forms the nitrogen rich vapor product 170. Through the use of this nitrogen heat pump cycle (involving condenser heat exchanger 454, compressor 466, and aftercooler 468) to make the top of the distillation column 462 even colder, a nitrogen rich product 170 of even higher purity (for example having a nitrogen concentration of about 99.9 mol %) can be obtained.

Figure 6:
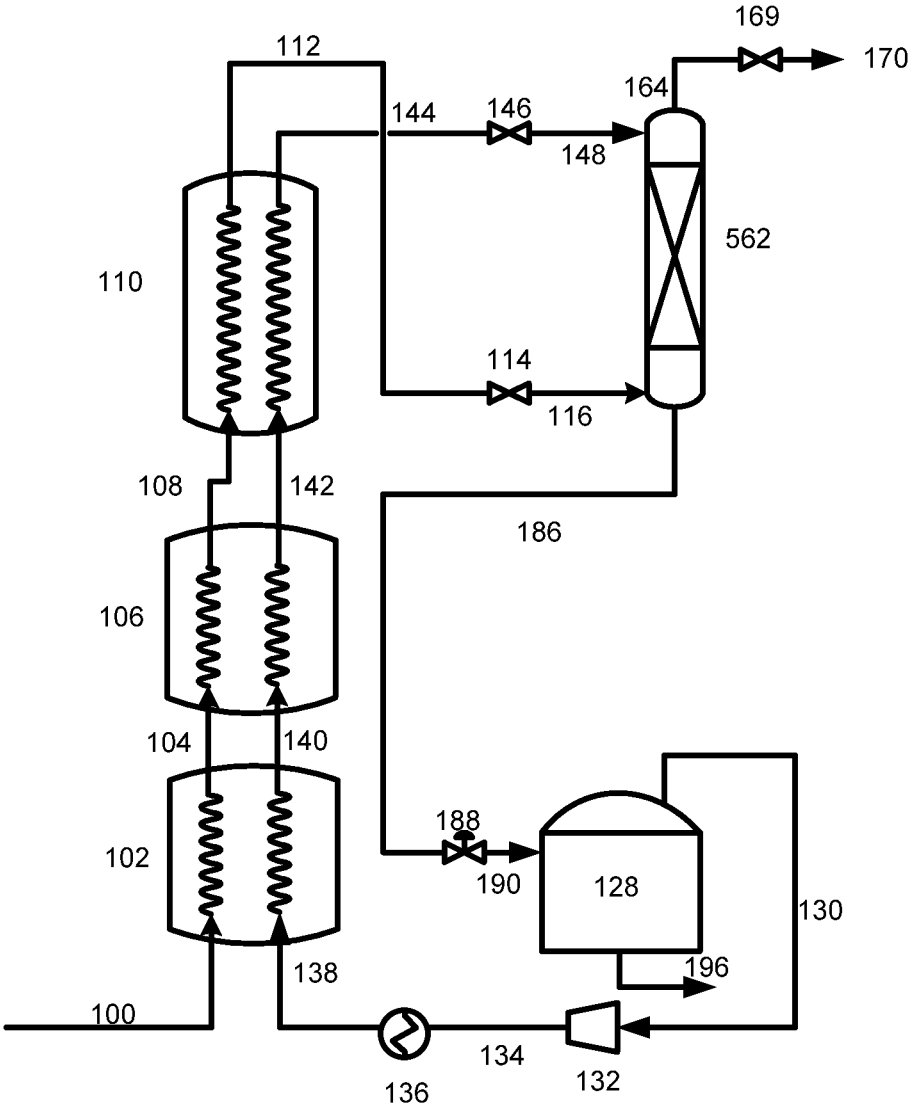
FIG. 6 is a schematic flow diagram depicting a method and apparatus according to another embodiment of the present invention.

The method and apparatus depicted in FIG. 6 differs from that depicted in FIG. 1 in that the distillation column 562 has one separation section, the first at least partially liquefied nitrogen-enriched natural gas stream 144 withdrawn from the cold end of the main heat exchanger is not separated into separate vapor and liquid streams before being introduced into and separated in the distillation column, and the first LNG stream 112 withdrawn from the cold end of the main heat exchanger is also introduced into and separated in the distillation column. More specifically, in this method and apparatus the first LNG stream 112 is expanded and partially vaporized, for example by being passed through J-T valve 114 or a turbo-expander (not shown), and is introduced as partially vaporized stream 116 into the bottom of the distillation column 562 for separation into vapor and liquid phases, thereby providing also stripping gas for the column. The first at least partially liquefied nitrogen-enriched natural gas stream 144 is expanded and partially vaporized, for example by being passed through J-T valve 146 or a turbo-expander (not shown), and is introduced as partially vaporized stream 148 into the top of the distillation column 562 for separation into vapor and liquid phases, thereby providing also reflux to the column. The nitrogen-depleted bottoms liquid is withdrawn from the bottom of the distillation column 562 forming second LNG stream 186 which, as before, is expanded and introduced into the LNG storage tank 128, from which the nitrogen-depleted LNG product 196 and the recycle stream 130 are then withdrawn (the expanded second LNG stream 190 being, in this case, the only LNG stream introduced into the LNG storage tank 128 or other separation system). The overhead vapor withdrawn from the top of the distillation column again forms the nitrogen-rich vapor product 170.

Figure 7:
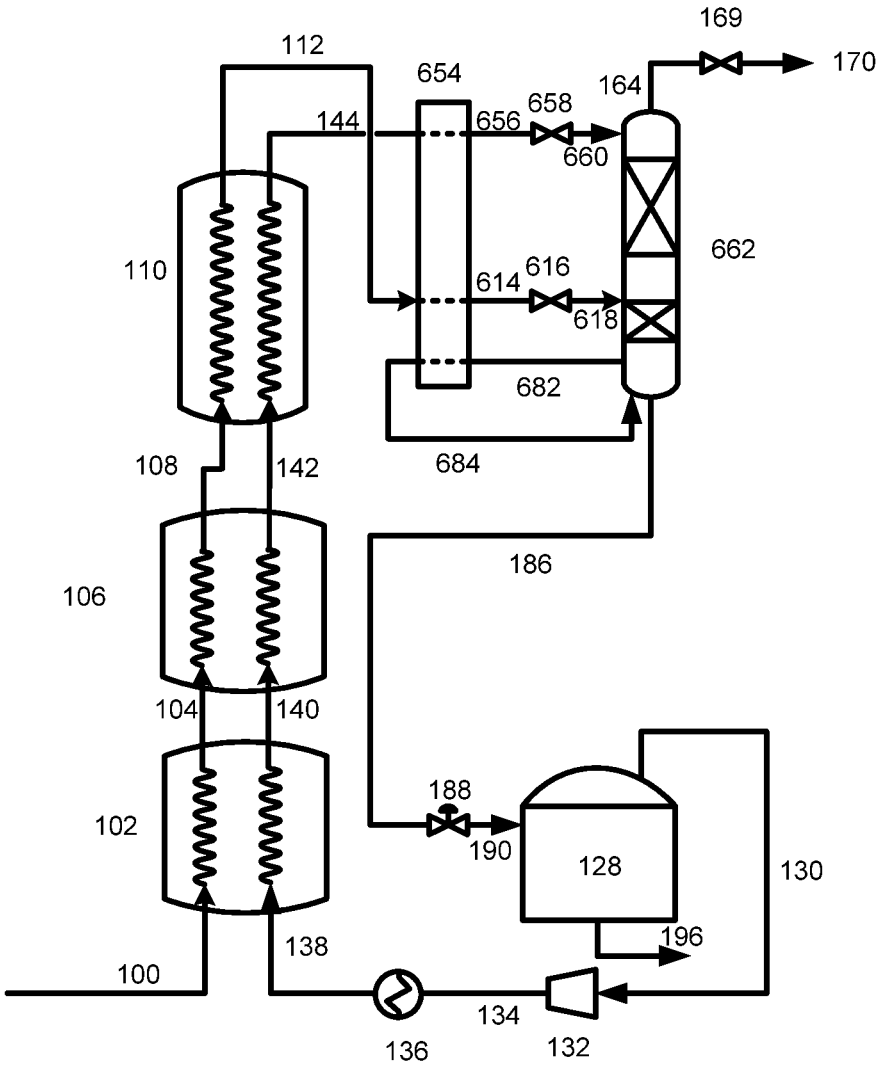
FIG. 7 is a schematic flow diagram depicting a method and apparatus according to another embodiment of the present invention.

The method and apparatus depicted in FIG. 7 differs from that depicted in FIG. 6 in that the distillation column 662 has two separation sections, the first LNG stream 112 being separated in the distillation column into vapor and liquid phases by being introduced into an intermediate location of the distillation column 662, between the two separation sections. More specifically, the first LNG stream 112 is cooled in reboiler heat exchanger 654, expanded and partially vaporized, for example by being passed through J-T valve 616 or a turbo-expander (not shown), and is introduced as partially vaporized stream 618 into the intermediate location of the distillation column 662. In this embodiment, the first at least partially liquefied nitrogen-enriched natural gas stream 144 also cooled in reboiler heat exchanger 654 before being expanded and partially vaporized, for example by being passed through J-T valve 658 or a turbo-expander (not shown), and introduced as partially vaporized stream 660 into the top of the distillation column 662. Boil-up for the column is provided by warming and vaporizing a portion 682 of the bottoms liquid from the column in the reboiler heat exchanger 654, the remainder of the bottoms liquid being withdrawn from the bottom of the distillation column to form the second LNG stream 186.

Figure 8:
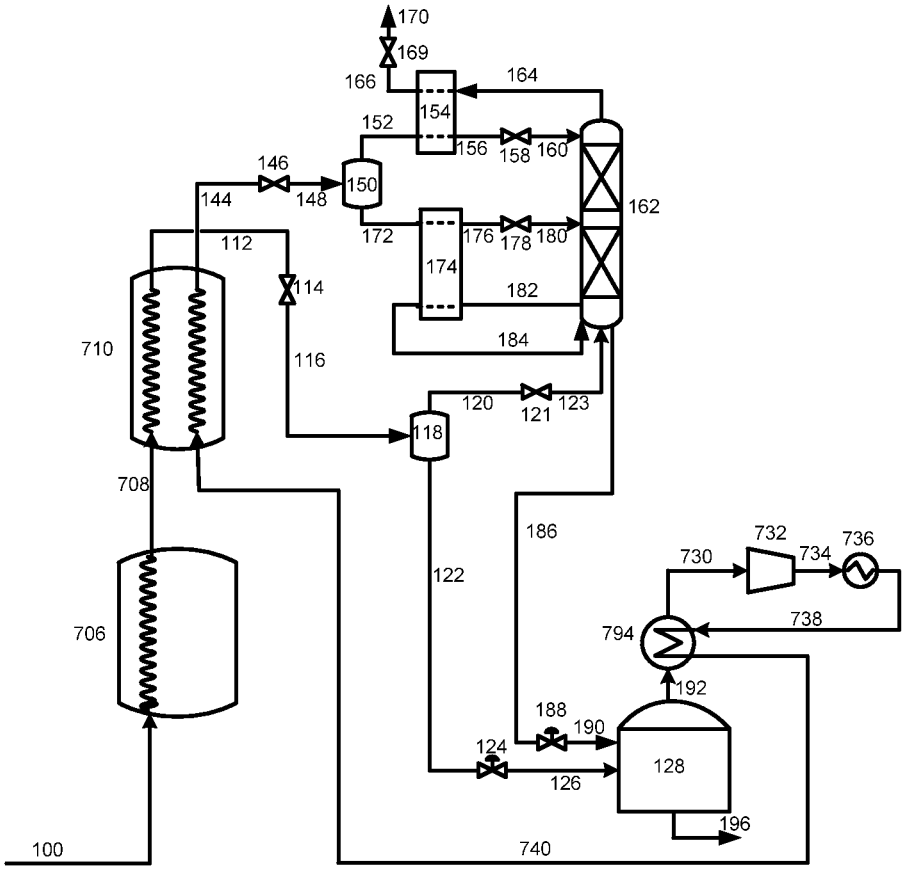
FIG. 8 is a schematic flow diagram depicting a method and apparatus according to another embodiment of the present invention.

The method and apparatus depicted in FIG. 8 differs from that depicted in FIG. 1, in that the compressed recycle stream is not introduced into the warm end of the main heat exchanger, but is instead introduced at an intermediate location between cooling sections of the main heat exchanger. By way of illustration, the main heat exchanger in this case also comprises only two cooling sections. Thus, in this method and apparatus the natural gas feed stream 100 is introduced into and cooled in a warm section 706, and the resulting cooled natural gas feed stream 708 is then liquefied and subcooled in a cold section 710 to produce the first LNG stream 112. The recycle stream 192 withdrawn from the LNG tank 128 first warmed in an economizer heat exchanger 794, and the warmed recycle stream is then compressed in compressor 732, cooled in aftercooler 736 (against a suitable cooling medium such as, for example, ambient temperature water or air), and then further cooled in the economizer heat exchanger (via heat exchange with the initially withdrawn recycle stream 192) to provide a cooled and compressed recycle stream 740. This cooled and compressed recycle stream, which as a result of cooling in the economizer heat exchanger is at a similar temperature to the cooled natural gas feed stream 708, is introduced into the main heat exchanger at an intermediate location between the two cooling sections, bypassing the warm section 706 of the main heat exchanger and passing through and being cooled and at least partially liquefied in the cold section 710 to provide the first at least partially liquefied nitrogen-enriched natural gas stream 144.

Figure 9:
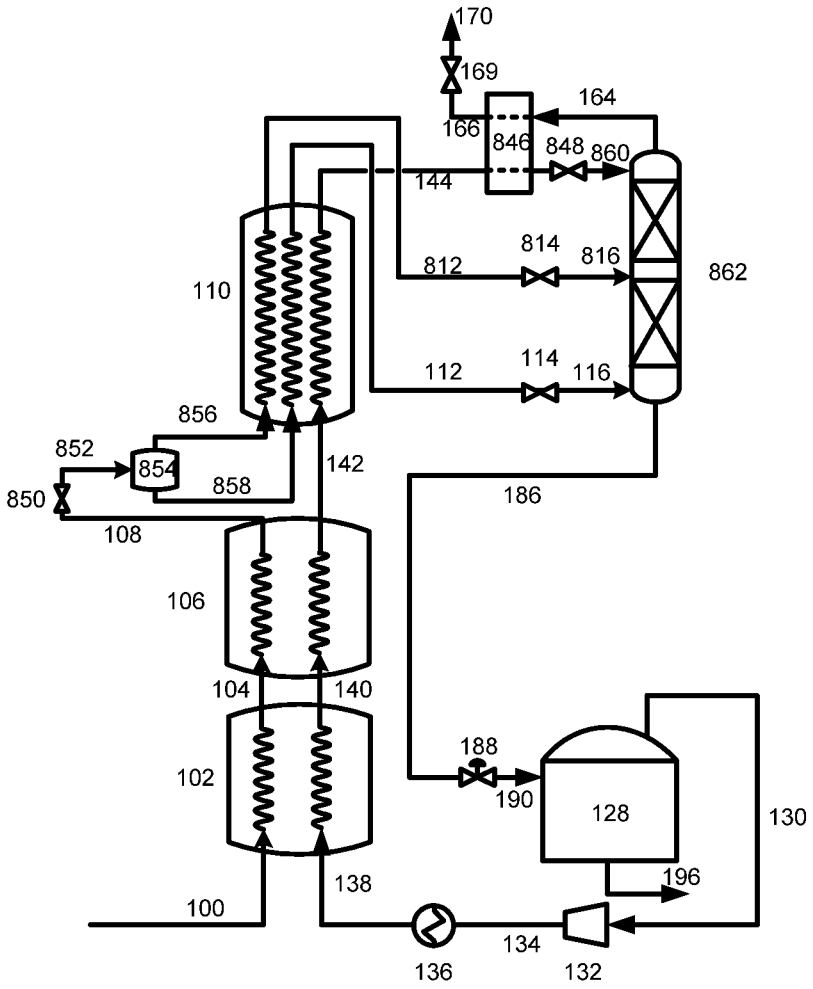
FIG. 9 is a schematic flow diagram depicting a method and apparatus according to another embodiment of the present invention.

The method and apparatus depicted in FIG. 9 differs from that depicted in FIG. 6 (and the other previously described embodiments) in that only a portion of the natural gas feed stream is liquefied and withdrawn from the main heat exchanger as the first LNG stream, another portion of the natural gas feed stream being withdrawn as a second at least partially liquefied nitrogen-enriched natural gas stream. More specifically, in embodiment depicted in FIG. 9 the liquefied natural gas feed stream 108 withdrawn from the middle or intermediate section 106 of the main heat exchanger is not sent directed to the cold section 110 of the main heat exchanger. Instead, the stream is expanded and partially vaporized, for example by being passed through J-T valve 850 (or any other suitable expansion device, such as for example a turbo-expander), and introduced into phase separator 854 where it is separated into a nitrogen-enriched natural gas vapor stream 856 and a nitrogen-depleted natural gas liquid stream 858. The two streams are then passed through separate cooling passages in the cold section 110 of the main heat exchanger so that the two streams are further cooled, separately but in parallel, so as to form the first LNG stream 112 from the nitrogen-depleted natural gas liquid stream 858 and the second at least partially liquefied nitrogen-enriched natural gas stream 812 from the nitrogen-enriched natural gas vapor stream 856.

The first LNG stream 112, second at least partially liquefied nitrogen-enriched natural gas stream 812, and first at least partially liquefied nitrogen-enriched natural gas stream 144, after being withdrawn from the cold end of the main heat exchanger, are then all sent to distillation column 862 to be separated into vapor and liquid phases. The distillation column 862 in this instance comprises two separation sections. The first LNG stream 112 (which in this example has the lowest nitrogen concentration of streams 112, 812 and 144) is expanded and partially vaporized, for example by being passed through J-T valve 114 or a turbo-expander (not shown), and introduced as partially vaporized stream 116 into the bottom of the distillation column 862, thereby providing also stripping gas for the column. The second at least partially liquefied nitrogen-enriched natural gas stream 812 is expanded and partially vaporized, for example by being passed through J-T valve 814 or a turbo-expander (not shown), and introduced as partially vaporized stream 816 into an intermediate location of the distillation column 862, between the two separation sections. The first at least partially liquefied nitrogen-enriched natural gas stream 144 (which in this example has the highest nitrogen concentration of streams 112, 812 and 144) is cooled in a heat exchanger 846, expanded and partially vaporized, for example by being passed through J-T valve 848 or a turbo-expander (not shown), and introduced as partially vaporized stream 860 into the top of the distillation column 862, thereby providing also reflux for the column. The nitrogen-depleted bottoms liquid is withdrawn from the bottom of the distillation column 862, forming second LNG stream 186 which, as before, is expanded and introduced into the LNG storage tank 128, from which the nitrogen-depleted LNG product 196 and the recycle stream 130 are then withdrawn (the expanded second LNG stream 190 being, in this case, the only LNG stream introduced into the LNG storage tank 128 or other separation system). The overhead vapor withdrawn from the top of the distillation column again forms a nitrogen-rich vapor product stream 164, which in this case is warmed in heat exchanger 846 (via indirect heat exchange with the first at least partially liquefied nitrogen-enriched natural gas stream 144) to provide a warmed nitrogen-rich vapor product stream 170. In this embodiment, the nitrogen-rich vapor product stream 164, 170 obtained from the top of the distillation column can be an almost pure nitrogen vapor stream.

Figure 10:
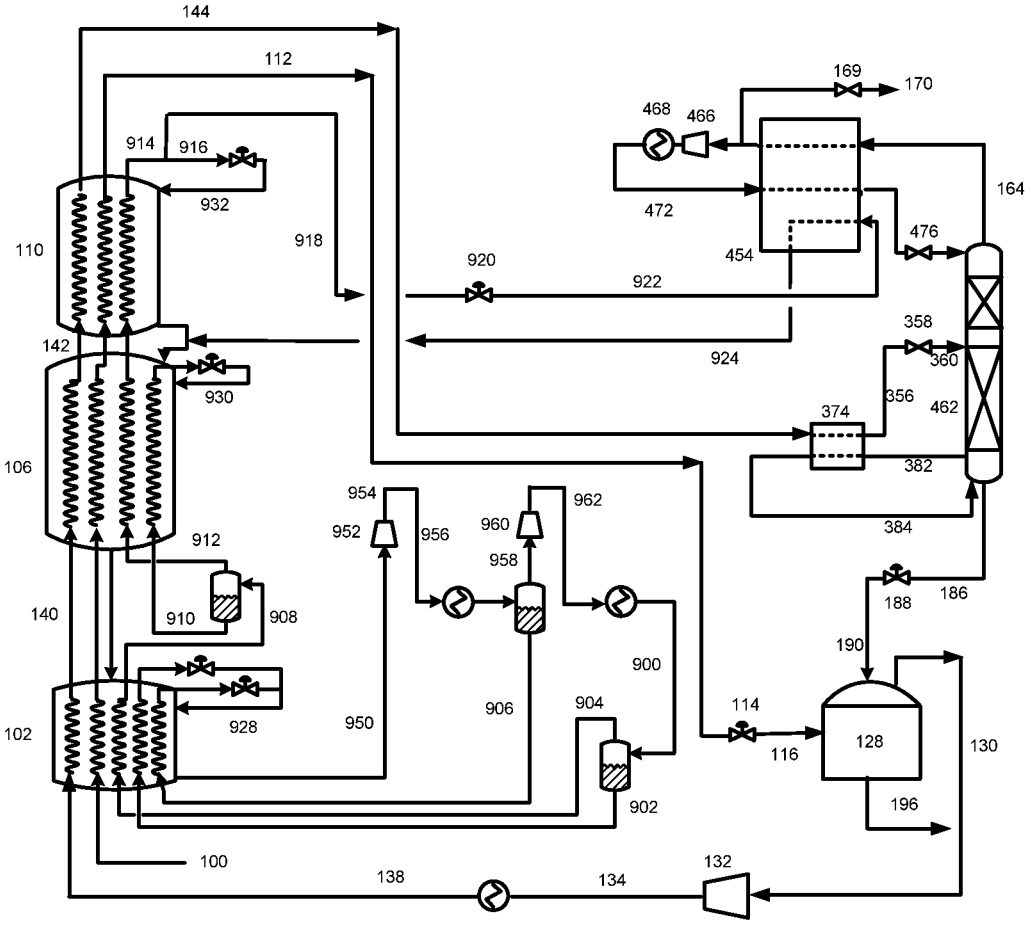
FIG. 10 is a schematic flow diagram depicting a method and apparatus according to another embodiment of the present invention.
Figure 11:
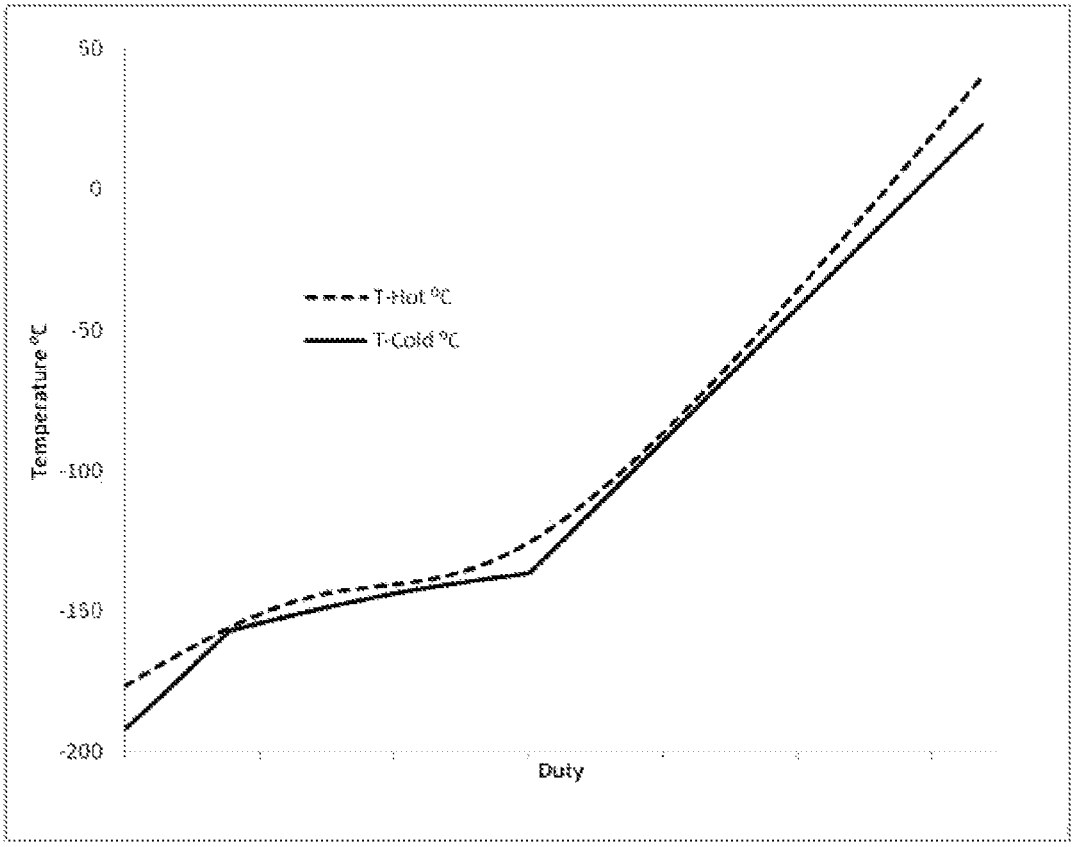
FIG. 11 is a graph showing the cooling curves for the condenser heat exchanger used in the method and apparatus depicted in FIG. 10.

The method and apparatus depicted in FIG. 10 differs from that depicted in FIG. 5 in that in this method and apparatus additional refrigeration for the condenser heat exchanger 454 is provided by a closed loop refrigeration system that provides refrigeration for the main heat exchanger. FIG. 10 also serves, more generally, to illustrate one possible closed loop refrigeration system that can be used to provide refrigeration to the main heat exchanger in any of the foregoing embodiments of the invention.

More specifically, and as illustrated in FIG. 10, refrigeration for the main heat exchanger may, for example, be provided by a single mixed refrigerant (SMR) system. In this type of closed loop system, the mixed refrigerant that is circulated consists of a mixture of components, such as a mixture of nitrogen, methane, ethane, propane, butane and isopentane. Also by way of illustration, each of cooling sections 102, 106 and 110 of the main heat exchanger is, in this example, a heat exchanger unit of the wound coil type. Warmed mixed refrigerant 950 exiting the warm end of the main heat exchanger is compressed in compressor 952 to form a compressed stream 956. The compressed stream is then passed through an aftercooler to cool and partly condense the stream, and is then separated in a phase separator into vapor 958 and liquid 906 streams. The vapor stream 958 is further compressed in compressor 960 and cooled and partly condensed to form a high pressure mixed refrigerant stream 900 at ambient temperature. The aftercoolers can use any suitable ambient heat sink, such as air, freshwater, seawater or water from an evaporative cooling tower.

The high pressure mixed refrigerant stream 900 is separated in a phase separator into vapor stream 904 and a liquid stream 902. Liquid streams 902 and 906 are then subcooled in the warm section 102 of the main heat exchanger, before being reduced in pressure and combined to form cold refrigerant stream 928 which is passed through the shell side of the warm section 102 of the main heat exchanger where it is vaporized and warmed to provide refrigeration to said section. Vapor stream 904 is cooled and partly liquefied in the warm section 102 of the main heat exchanger, exiting as stream 908. Stream 908 is then separated in a phase separator into vapor stream 912 and liquid stream 910. Liquid stream 910 is subcooled in the middle section 106 of the main heat exchanger, and then reduced in pressure form cold refrigerant stream 930 which is passed through the shell side of the middle section 106 of the main heat exchanger where it is vaporized and warmed to provide refrigeration to said section. Vapor stream 912 is condensed and subcooled in the middle 106 and cold 110 sections of the main heat exchanger exiting as stream 914. Stream 914 is expanded to provide at least cold refrigerant stream 932, which is passed through the shell side of the cold section 110 of the main heat exchanger where it is vaporized and warmed to provide refrigeration to said section. The warmed refrigerant (derived from stream 932) exiting the shell side of cold section 110 is combined with refrigerant stream 930 in the shellside of the middle section 106, where it is further warmed and vaporized providing additional refrigerant to that section. The combined warmed refrigerant exiting the shell side of middle section 106 is combined with refrigerant stream 928 in the shell side of warm section 102, where it is further warmed and vaporized providing additional refrigerant to that section. The combined warmed refrigerant exiting the shell side of the warm section 102 has been fully vaporized and superheated by about 5° C., and exits as warmed mixed refrigerant stream 950 thus completing the refrigeration loop.

As noted above, in the embodiment depicted in FIG. 10 the closed loop refrigeration system also provides refrigeration for the condenser heat exchanger 454 that condenses a portion 472 of the overhead vapor 164 from the distillation column 462 so as to provide reflux for said column. This is achieved by dividing the cooled mixed refrigerant exiting the main heat exchanger and sending a portion of said refrigerant to be warmed in the condenser heat exchanger 454 before being returned to and further warmed in the main heat exchanger. More specifically, mixed refrigerant steam 914 exiting the cold end of the main heat exchanger is divided into two portions, a minor portion 918 (typically less than 10%) and a major portion 916. The major portion is expanded to provide the cold refrigerant stream 932 that is used to provide refrigerant to the cold section 110 of the main heat exchanger, as described above. The minor portion 918 is expanded, for example by passing the stream through a J-T valve 920 another suitable form of expansion device (such as for example a turbo-expander), to form cold refrigerant stream 922. Stream 922 is then warmed and at least partly vaporized in the condenser heat exchanger 454, producing stream 924 that is then returned to the main heat exchanger by being combined with the warmed refrigerant (derived from stream 932) exiting the shell side of cold section 110 and entering the shell side of the middle section 106 with refrigerant stream 930. Alternatively, stream 924 could also be directly mixed with stream 930 (not shown).

The use of the closed loop refrigeration system to provide also refrigeration for the condenser heat exchanger 454 improves the overall efficiency of the process by minimizing the internal temperature differences in the condenser exchanger 454, with the mixed refrigerant providing cooling at the appropriate temperature where the condensation of the recycled nitrogen is occurring. This is illustrated by the cooling curves depicted in FIG. 11 that are obtained for the condenser heat exchanger 454 when operated in accordance with the embodiment depicted in FIG. 10 and described above. Preferably, the discharge pressure of the compressor 466 is chosen such that the compressed and warmed portion of the overhead vapor 472 that is to be cooled in the condenser heat exchanger 454 condenses at a temperature just above the temperature at which the mixed refrigerant vaporizes. The overhead vapor 164 withdrawn from the distillation column 462 may enter the condenser heat exchanger 454 at its dew point (about −159° C.), and be warmed to near ambient condition. After withdrawal of the nitrogen-rich vapor product 170, the remaining overhead vapor is then compressed in compressor 466, cooled in aftercooler 468 to near ambient temperature and returned to the condenser heat exchanger 454 to be cooled and condensed, providing reflux for the distillation column 462, as previously described.

Example

In order to illustrate the operation of the invention, the process described and depicted in FIG. 1 was followed in order to obtain a nitrogen vent stream with only 1 mol % methane and a liquefied natural gas product with only 1 mol % nitrogen. The feed gas composition was as shown in Table 1. The compositions of the primary streams is given in Table 2. The data was generated using ASPEN Plus software. As can be seen from the data in Table 2, the process is able to effectively remove nitrogen from liquefied natural gas stream and provide a sellable LNG product as well as a nitrogen stream that can be vented.

TABLE 1

| Feed conditions and composition considered | |
|---|---|
| Temperature (° F.) | 91.4 |
| Pressure (psia) | 957 |
| Flowrate (lbmol/hr) | 4098 |
| Component (mol %) | |
| $N_2$ | 5.0 |
| $C_1$ | 92.0 |
| $C_2$ | 1.5 |
| $C_3$ | 1.0 |
| $nC_4$ | 0.40 |
| $nC_5$ | 0.10 |

TABLE 2

| Stream compositions | 144 | 152 | 172 | 120 | 122 | 186 | 170 | 196 |
|---|---|---|---|---|---|---|---|---|
| Mole Fraction % | | | | | | | | |
| $N_2$ | 39.2 | 86.6 | 36.0 | 43.6 | 4.0 | 5.9 | 99.0 | 1.0 |
| C1 | 60.8 | 13.4 | 64.0 | 56.4 | 92.9 | 94.1 | 1.0 | 95.9 |
| C2 | 0.0 | 0.0 | 0.0 | 0.0 | 1.5 | 0.0 | 0.0 | 1.6 |
| C3 | 0.0 | 0.0 | 0.0 | 0.0 | 1.0 | 0.0 | 0.0 | 1.0 |
| nC4 | 0.0 | 0.0 | 0.0 | 0.0 | 0.4 | 0.0 | 0.0 | 0.4 |
| nC5 | 0.0 | 0.0 | 0.0 | 0.0 | 0.1 | 0.0 | 0.0 | 0.1 |
| Temperature ° F. | −245.1 | −252.7 | −252.7 | −246.0 | −246.0 | −269.6 | −257.5 | −262.5 |
| Pressure psia | 448.6 | 127.9 | 127.9 | 43.5 | 43.5 | 23.2 | 18.0 | 15.2 |
| Vapor Fraction | 0.0 | 1.0 | 0.0 | 1.0 | 0.0 | 0.0 | 1.0 | 0.0 |
| Total Flow lbmol/hr | 583.7 | 37.0 | 546.7 | 101.6 | 3996.7 | 435.3 | 171.1 | 3945.2 |

It will be appreciated that the invention is not restricted to the details described above with reference to the preferred embodiments but that numerous modifications and variations can be made without departing from the spirit or scope of the invention as defined in the following claims.

The invention claimed is:

1. A method for producing a nitrogen-depleted LNG product, the method comprising:

(a) passing a natural gas feed stream through a main heat exchanger to cool the natural gas feed stream and liquefy all or a portion of said natural gas feed stream, thereby producing a first LNG stream;

(b) withdrawing the first LNG stream from the main heat exchanger;

(c) (i) expanding and partially vaporizing the first LNG stream and introducing said expanded and vaporized first LNG stream into a distillation column to separate the expanded and vaporized first LNG stream into vapor and liquid phases;

(c) (ii) forming a second LNG stream from bottoms liquid withdrawn from the distillation column;

(c) (iii) expanding, partially vaporizing and then separating the second LNG stream in an LNG storage tank to form a nitrogen-depleted LNG product and a recycle stream composed of nitrogen-enriched natural gas vapor;

(d) compressing the recycle stream to form a compressed recycle stream;

(e) passing the compressed recycle stream through the main heat exchanger, separately from and in parallel with the natural gas feed stream, to cool the compressed recycle stream and at least partially liquefy all or a portion thereof, thereby producing a first at least partially liquefied nitrogen-enriched natural gas stream;

(f) withdrawing the first at least partially liquefied nitrogen-enriched natural gas stream from the main heat exchanger; and (g) expanding and partially vaporizing the first at least partially liquefied nitrogen-enriched natural gas stream to form an expanded and vaporized nitrogen-enriched natural gas stream, introducing said expanded and vaporized nitrogen-enriched natural gas stream into the distillation column to separate the expanded and vaporized nitrogen-enriched natural gas stream into vapor and liquid phases, and forming the nitrogen-rich vapor product from overhead vapor withdrawn from the distillation column;

wherein the first LNG stream is introduced into the distillation column at a location below the location at which the first at least partially liquefied nitrogen-enriched natural gas steam is introduced into the column, and wherein refrigeration for the main heat exchanger is provided by a closed loop refrigeration system, refrigerant circulated by the closed loop refrigeration system passing through and being warmed in the main heat exchanger.

2. The method of claim 1, wherein the first LNG stream is introduced into the bottom of the distillation column.

3. The method of claim 1, wherein the first at least partially liquefied nitrogen-enriched natural gas stream is introduced into the top of the distillation column.

4. The method of claim 1, wherein the main heat exchanger comprises a warm end into which the natural gas feed stream and compressed recycle stream are introduced in parallel, and a cold end from which the first LNG stream and first at least partially liquefied nitrogen-enriched natural gas stream are withdrawn in parallel.

5. An apparatus for producing a nitrogen-depleted LNG product, the apparatus comprising:

a main heat exchanger having cooling passages for receiving a natural gas feed stream and passing the natural gas feed stream through the heat exchanger to cool the natural gas feed stream and liquefy all or a portion of the natural gas feed stream so as to produce a first LNG stream, and for receiving a compressed recycle stream composed of nitrogen-enriched natural gas vapor and passing the compressed recycle stream through the heat exchanger to cool and at least partially liquefy the compressed recycle stream so as to produce a first at least partially liquefied nitrogen-enriched natural gas stream, wherein said cooling passages are arranged so as to pass the compressed recycle stream through the heat exchanger separately from and in parallel with the natural gas feed stream;

a refrigeration system for supplying refrigerant to the main heat exchanger for cooling the cooling passages;

a first separation system, in fluid flow communication with the main heat exchanger, for receiving, expanding, partially vaporizing and separating the first at least partially liquefied nitrogen-enriched natural gas stream to form a nitrogen-rich vapor product, and for receiving, expanding, partially vaporizing and separating the first LNG stream to form a second LNG stream, whereby the first separation system comprises an expansion device for expanding and partially vaporizing the first at least partially liquefied nitrogen-enriched natural gas stream, an expansion device for expanding and partially vaporizing the first LNG stream, and a distillation column for separating the first at least partially liquefied nitrogen-enriched natural gas stream and the first LNG stream into vapor and liquid phases, whereby the first LNG stream is introduced into the distillation column at a location below the location at which the first at least partially liquefied nitrogen-enriched natural gas stream is introduced into the column, the nitrogen-rich vapor product being formed from overhead vapor withdrawn from the distillation column and the second LNG stream being formed from bottoms liquid withdrawn from the distillation column;

a second separation system, in fluid flow communication with the first separation system, for receiving, expanding, partially vaporizing and separating the second LNG stream to form a nitrogen-depleted LNG product and a recycle stream composed of nitrogen-enriched natural gas vapor;

a compressor, in fluid flow communication with the second separation system and the main heat exchanger, for receiving the recycle stream, compressing the recycle stream to form the compressed recycle stream, and returning the compressed recycle stream to the main heat exchanger; wherein the refrigeration system is a closed loop refrigeration system, and the second separation system comprises an expansion device and an LNG tank.

* * * * *